US010449982B2

(12) United States Patent
Kashima

(10) Patent No.: US 10,449,982 B2
(45) Date of Patent: Oct. 22, 2019

(54) WIRELESS COMMUNICATION SYSTEM, WIRELESS COMMUNICATION DEVICE, WIRELESS COMMUNICATION METHOD, MOVABLE FENCE CONTROL SYSTEM, COMMUNICATION DEVICE, AND MOVABLE FENCE DEVICE

(71) Applicant: Hitachi Kokusai Electric Inc., Tokyo (JP)

(72) Inventor: Kenichi Kashima, Tokyo (JP)

(73) Assignee: Hitachi Kokusai Electric Inc., Tokyo (JP)

( * ) Notice: Subject to any disclaimer, the term of this patent is extended or adjusted under 35 U.S.C. 154(b) by 412 days.

(21) Appl. No.: 15/311,637

(22) PCT Filed: May 20, 2014

(86) PCT No.: PCT/JP2014/063362
§ 371 (c)(1),
(2) Date: Nov. 16, 2016

(87) PCT Pub. No.: WO2015/177871
PCT Pub. Date: Nov. 26, 2015

(65) Prior Publication Data

US 2017/0080962 A1 Mar. 23, 2017

(51) Int. Cl.
*B61L 29/30* (2006.01)
*B61L 27/00* (2006.01)
(Continued)

(52) U.S. Cl.
CPC ..... *B61L 29/30* (2013.01); *B61L 23/041* (2013.01); *B61L 25/021* (2013.01);
(Continued)

(58) Field of Classification Search
CPC ..... B61L 29/30; B61L 29/32; B61L 25/025; B61L 29/08
(Continued)

(56) References Cited

U.S. PATENT DOCUMENTS 4,551,944 A * 11/1985 Donaldson ..... B61B 1/02 49/262
5,786,998 A * 7/1998 Neeson ..... B61L 25/021 340/3.1
(Continued)

FOREIGN PATENT DOCUMENTS

JP 2002-264811 A 9/2002
JP 2004-077519 A 3/2004
(Continued)

OTHER PUBLICATIONS

International Search Report of PCT/JP2014/063362 dated Aug. 19, 2014.

*Primary Examiner* — Zachary L Kuhfuss
(74) *Attorney, Agent, or Firm* — Mattingly & Malur, PC

(57) ABSTRACT

One of the first and second wireless communication devices is disposed in a mobile object, and the other is fixed. The first wireless communication device includes a wireless transmission/reception unit that transmits data to the second wireless communication device and performs wireless transmission and reception in order to detect whether the mobile object is stopped. When, in a first mode for transmitting data to the second wireless communication device and determining whether the reception strength of a received signal is equal to or greater than a first value, the first wireless communication device detects that the reception strength is equal to or greater than the first value, the first wireless communication device stops the transmission of data to the second wireless communication device, exits the first mode, and transitions to a second mode for determining whether the mobile object is stopped.

15 Claims, 10 Drawing Sheets

(51) Int. Cl.
*B61L 23/04* (2006.01)
*B61L 25/02* (2006.01)

(52) U.S. Cl.
CPC ..... *B61L 25/025* (2013.01); *B61L 27/0005* (2013.01); *B61L 27/0077* (2013.01); *B61L 2205/00* (2013.01)

(58) Field of Classification Search
USPC ..... 104/28, 30, 31
See application file for complete search history.

(56) References Cited

U.S. PATENT DOCUMENTS 6,340,139 B1 * 1/2002 Hilleary ..... B61L 29/08 246/125
6,341,563 B1 * 1/2002 Gal ..... B61D 19/026 104/28
7,677,178 B2 * 3/2010 Ellmann ..... B61B 1/02 104/27
7,721,653 B1 * 5/2010 Burgess ..... B61B 1/02 104/27
7,913,628 B2 * 3/2011 Chisena ..... B61K 13/04 104/28
8,109,214 B2 * 2/2012 Bradley ..... B61B 1/02 104/28
8,596,587 B2 * 12/2013 Hilleary ..... B61L 23/041 246/125
2015/0066255 A1 * 3/2015 Hilleary ..... B61L 29/30 701/19
2017/0080962 A1 * 3/2017 Kashima ..... B61L 27/0005

FOREIGN PATENT DOCUMENTS

JP 2010-052556 A 3/2010
JP 2014-061796 A 4/2014

* cited by examiner

FIG. 4

(a) POLLING CALL FORMAT

| DEVICE NUMBER | TRAIN NUMBER | DATA |
|---|---|---|

(b) POLLING RESPONSE FORMAT

| DEVICE NUMBER | STATION NUMBER | PLATFORM NUMBER | DATA |
|---|---|---|---|

(c) DATA TRANSMISSION FORMAT

| DEVICE NUMBER | TRAIN NUMBER | DEVICE CONDITION | TRANSMISSION DATA |
|---|---|---|---|

(d) DATA TRANSMISSION FORMAT

| DEVICE NUMBER | STATION NUMBER | PLATFORM NUMBER | DEVICE CONDITION | TRANSMISSION DATA |
|---|---|---|---|---|

32 BYTES 1500 BYTES

WIRELESS COMMUNICATION SYSTEM, WIRELESS COMMUNICATION DEVICE, WIRELESS COMMUNICATION METHOD, MOVABLE FENCE CONTROL SYSTEM, COMMUNICATION DEVICE, AND MOVABLE FENCE DEVICE

TECHNICAL FIELD

The present invention relates to a wireless technology having a mobile object stop detection function and a data communication function.

BACKGROUND ART

In a background art for determining a train stop state and a train stop position, for example, multiple IC tags are disposed at intervals near rails along a station platform, and an IC tag reader is mounted on the bottom or lateral surface of a train car in order to read information in the IC tags. Position information is recorded in the IC tags. A train entering the station platform successively determines the position of the train by allowing the IC tag reader to wirelessly read the information in the IC tags. When the train stops, the IC tag reader verifies whether the train is stopped and determines whether the train is stopped within a predetermined positional range. As described above, a dedicated train position determination facility is provided for the ground side to permit the train side to determine its position.

Further, a wireless communication device is installed on the train side and on the ground side in order to transmit data (communicate data) between the train side and the ground side. A surveillance camera is mounted on the station platform to monitor safety on the platform. A ground wireless communication device wirelessly transmits data, such as image information captured by a surveillance camera, to the train side. The captured image information is displayed on a monitor near a train driver seat. This enables a train driver to confirm the safety of passengers getting on and off the train. A platform monitoring system disclosed in Patent Literature 1 is configured so that a surveillance camera is installed on a platform to transmit a captured image to a train.

Moreover, a movable platform door (movable fence) is installed in recent years in order to prevent passengers from falling from a platform or coming into contact with the train. Additionally, an image showing an area near the movable fence is captured by a surveillance camera, wirelessly transmitted to the train, and displayed on the monitor near the train driver seat. This permits the train driver to open or close the movable fence after verifying the safety of passengers getting on and off the train.

CITATION LIST

Patent Literature

PTL 1: Japanese Patent Application Laid-Open No. 2002-264811

SUMMARY OF INVENTION

Technical Problem

As described above, when the background art is used, it is necessary to provide both the train side and the ground side with a wireless communication facility for data transmission and install a dedicated ground facility for determining whether a train is stopped. This results in an increase in the cost of ground facility installation.

An object of the present invention is to provide a technology that establishes wireless communication between a mobile object (e.g., a train) and a fixed object (e.g., a ground facility) in order to transmit data and determine whether the mobile object is stopped.

Solution to Problem

In order to address the above problem, a wireless communication system according to the present invention has the following typical configuration.

The wireless communication system includes a first wireless communication device and a second wireless communication device. The second wireless communication device wirelessly communicates with the first wireless communication device. One of the first and second wireless communication devices is disposed in a mobile object, and the other is fixed. The first wireless communication device includes a wireless transmission/reception unit that transmits data to the second wireless communication device and performs wireless transmission and reception in order to detect whether the mobile object is stopped. When, in a first mode for transmitting data to the second wireless communication device and determining whether the reception strength of a received signal is equal to or greater than a first value, the first wireless communication device detects that the reception strength is equal to or greater than the first value, the first wireless communication device stops the transmission of data to the second wireless communication device, exits the first mode, and transitions to a second mode for determining whether the mobile object is stopped. Upon detecting in the second mode that the mobile object is stopped, the first wireless communication device exits the second mode and transmits data to the second wireless communication device.

In order to address the above problem, a wireless communication device according to the present invention has the following typical configuration.

The wireless communication device moves relative to a different wireless communication device and wirelessly communicates with the different wireless communication device. The wireless communication device includes a wireless transmission/reception unit that transmits data to the different wireless communication device and performs wireless transmission and reception in order to detect whether the relative movement is stopped. When, in a first mode for transmitting data to the different wireless communication device and determining whether the reception strength of a received signal is equal to or greater than a first value, the wireless communication device detects that the reception strength is equal to or greater than the first value, the wireless communication device stops the transmission of data to the different wireless communication device, exits the first mode, and transitions to a second mode for determining whether the relative movement is stopped. When the wireless communication device detects in the second mode that the relative movement is stopped, the wireless communication device exits the second mode and transmits data to the different wireless communication device.

In order to address the above problem, a wireless communication method according to the present invention has the following typical configuration.

The wireless communication method is exercised between an on-vehicle wireless communication device and a ground wireless communication device. The on-vehicle wireless communication device is disposed in a mobile object. The wireless communication method includes a first step, a second step, and a third step. The first step determines whether the reception strength of a received signal is equal to or greater than a first value while data is being wirelessly transmitted between the on-vehicle wireless communication device and the ground wireless communication device. The second step stops the data transmission between the on-vehicle wireless communication device and the ground wireless communication device after detecting that the reception strength is equal to or greater than the first value, and wirelessly determines whether the mobile object is stopped. The third step wirelessly transmits data between the on-vehicle wireless communication device and the ground wireless communication device after detecting that the mobile object is stopped.

In order to address the above problem, a movable fence control system according to the present invention has the following typical configuration.

The movable fence control system includes a first wireless communication device, a second wireless communication device, a movable fence device, and a control device. The first wireless communication device is disposed on a train. The second wireless communication device selectively operates in a data transmission mode and in a radar mode. The data transmission mode wirelessly communicates with the first wireless communication device. The radar mode wirelessly detects whether the train is stopped. The movable fence device is disposed on a station platform to open and close a door. Upon receipt of door opening instruction information from the second wireless communication device, the control device exercises control to open the door. The door opening instruction information is an instruction for a door opening operation.

In order to address the above problem, a communication device according to the present invention has the following typical configuration.

The communication device establishes wireless communication with an on-vehicle wireless communication device disposed on a train in order to communicate with a control device that controls a door opening operation for opening a door of a movable fence device disposed on a station platform to open and close the door. The communication device selectively operates in a data transmission and in a radar mode. The data transmission mode wirelessly communicates with the on-vehicle wireless communication device. The radar mode wirelessly detects whether the train is stopped. Upon receipt of a signal requesting the door opening operation from the on-vehicle wireless communication device in the data transmission mode after detecting the stoppage of the train in the radar mode, the communication device transmits door opening instruction information to the control device. The door opening instruction information is an instruction for the door opening operation.

In order to address the above problem, a movable fence device according to the present invention has the following typical configuration.

The movable fence device is disposed on a station platform and capable of opening and closing a door. The movable fence device includes a control device that communicates with a communication device. The communication device selectively operates in a data transmission mode and in a radar mode. The data transmission mode wirelessly communicates with an on-vehicle wireless communication device disposed on a train. The radar mode wirelessly detects whether the train is stopped. Upon receipt of door opening instruction information from the communication device, the control device exercises control to open the door. The door opening instruction information is an instruction for a door opening operation.

Advantageous Effects of Invention

The above-described configurations make it possible to transmit data and determine the stoppage of a mobile object by establishing wireless communication between a mobile object side and a fixed object side.

BRIEF DESCRIPTION OF DRAWINGS

FIGS. 4 (*a*) to 4 (*d*) are communication formats of the wireless communication system according to the embodiment of the present invention.

DESCRIPTION OF EMBODIMENTS

Figure 1:
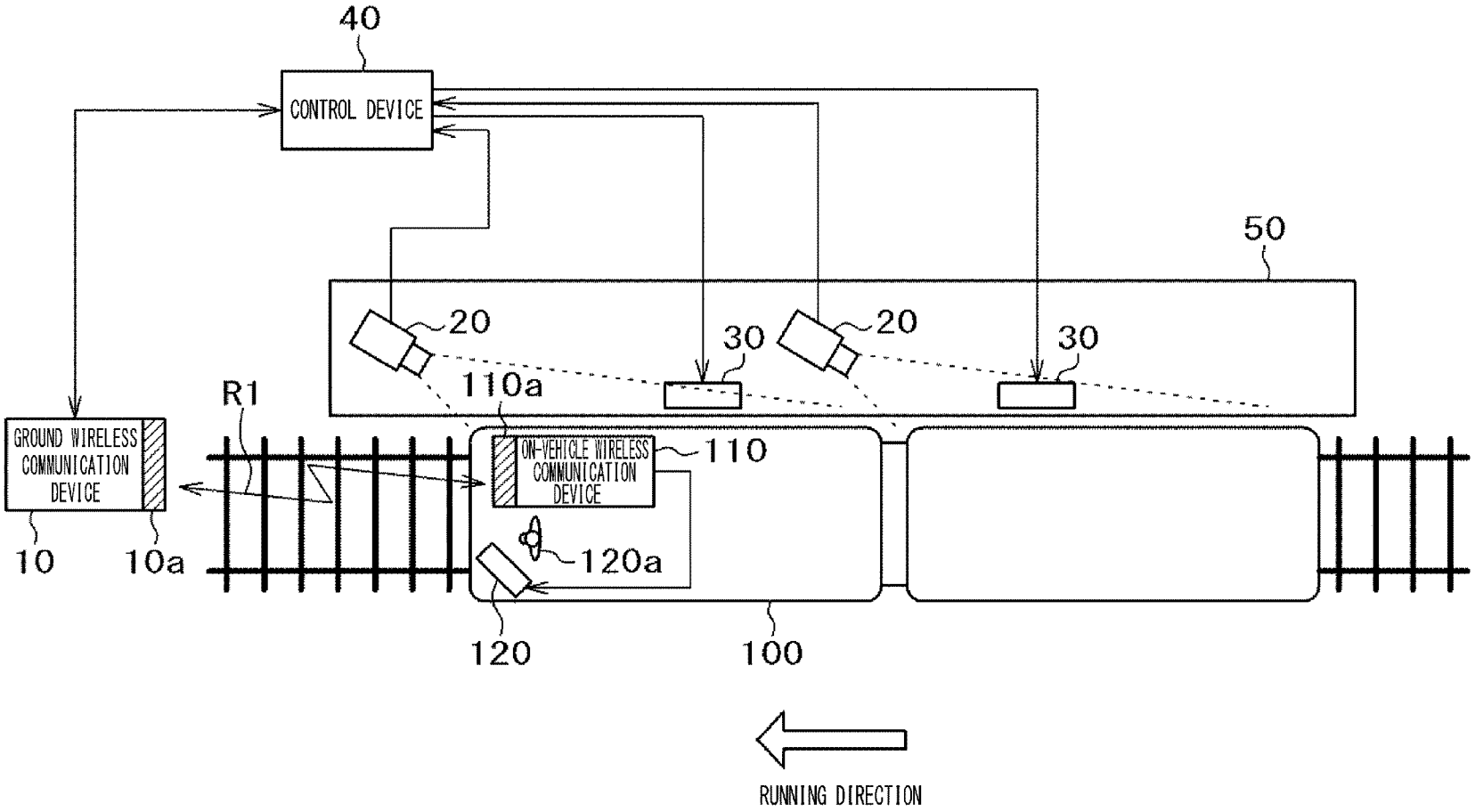
FIG. 1 is a diagram illustrating a configuration of a wireless communication system according to an embodiment of the present invention.

FIG. 1 is a diagram illustrating a configuration of a wireless communication system according to an embodiment of the present invention.

Referring to FIG. 1, the reference sign 10 denotes a ground wireless communication device. The ground wireless communication device 10 is fixed to a position that does not obstruct the running of a vehicle 100, such as a position above the vehicle 100 or near a railway track. The reference sign 50 denotes a station platform (or simply a platform). FIG. 1 illustrates a state where the vehicle 100 is moving toward the ground wireless communication device and is about to stop at the station platform 50.

The reference sign 20 denotes a surveillance camera that captures a situation in which the station platform 50 and the vehicle 100 are placed. The reference symbol 30 denotes a movable fence device disposed on the station platform 50. A door of the movable fence device 30 can be automatically opened and closed. The reference sign 40 denotes a control device that is capable of communicating with the ground wireless communication device 10 and used to exercise control, for example, in order to open or close the door of the movable fence device 30. The reference sign 110 denotes an on-vehicle wireless communication device that is disposed on the vehicle 100, which is a mobile object, and used to wirelessly communicate with the ground wireless communication device 10. The reference sign 120 denotes an operation/display device disposed on the vehicle 100. The reference sign 120*a* denotes a train driver. The control device 40 may control the surveillance camera 20 to receive and record an image captured by the surveillance camera 20. Alternatively, however, a device for controlling the surveillance camera 20 and receiving and recording an image captured by the surveillance camera 20 may be provided separately from the control device 40.

The ground wireless communication device 10, the surveillance camera 20, and the movable fence device 30 are communicatively connected to the control device 40. The on-vehicle wireless communication device 110 is communicatively connected to the operation/display device 120. The ground wireless communication device 10 and the on-vehicle wireless communication device 110 are capable of wirelessly communicating with each other (performing a data transmission operation and a radar operation) through an antenna 10*a* of the former device 10 and an antenna 110*a* of the latter device 110.

The radar operation (radar mode) is an operation performed to transmit an electromagnetic wave from the ground wireless communication device 10 to the vehicle 100, receive an electromagnetic wave reflected from the vehicle 100, and analyze the time lag between the transmitted and received electromagnetic waves and their frequencies in order to measure the distance between the ground wireless communication device 10 and the vehicle 100 and the movement speed of the vehicle 100 and detect whether the vehicle 100 is stopped. Details will be described later with reference to FIGS. 8 (*a*), 8 (*b*), 9 (*a*), and 9 (*b*).

The antenna 10*a* of the ground wireless communication device 10 preferably has directivity so as to be able to transmit and receive an electromagnetic wave to and from the antenna 110*a* of the on-vehicle wireless communication device 110, receive an electromagnetic wave reflected from the vehicle 100, and inhibit an electromagnetic wave from being received from any other direction. The orientation and directivity of the antenna 10*a* are determined in consideration, for example, of the direction of a railway track of a station where the ground wireless communication device 10 is installed.

During a radar operation, the antenna 10*a* has such directivity as to be able to transmit a beam-shaped electromagnetic wave that fits into a region having, for example, a radius of approximately 3 m at a distance of 40 m ahead. The antenna 10*a* preferably functions as a radar operation antenna and as a data transmission antenna. However, the antenna 10*a* may alternatively be formed of two antennas. The antenna 10*a* may be disposed separately from the ground wireless communication device 10.

Similarly, the antenna 110*a* of the on-vehicle wireless communication device 110 preferably has directivity so as to be able to transmit and receive an electromagnetic wave to and from the antenna 10*a* of the ground wireless communication device 10 and inhibit an electromagnetic wave from being received from any other direction. The antenna 110*a* may be disposed separately from the on-vehicle wireless communication device 110.

Figure 2:
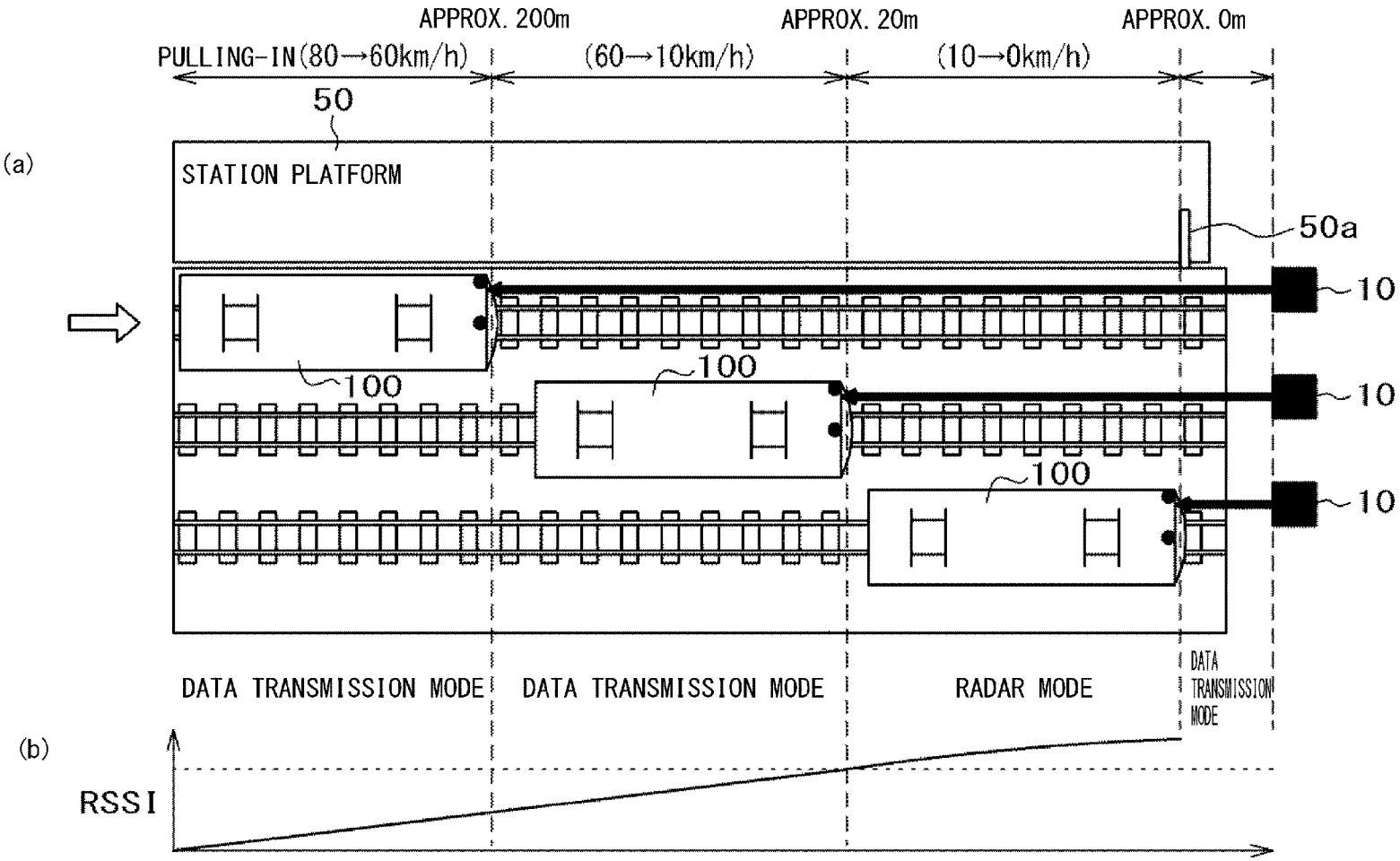
FIGS. 2 (*a*) and 2 (*b*) are diagrams outlining an operation of the wireless communication system according to the embodiment of the present invention.

FIGS. 2 (*a*) and 2 (*b*) are diagrams outlining an operation of the wireless communication system according to the embodiment of the present invention.

FIG. 2 (*a*) illustrates the positional relationship between, for example, the vehicle 100 and the station platform 50. Referring to FIG. 2 (*a*), the antenna 110*a* of the on-vehicle wireless communication device 110 is installed on the front of the vehicle 100, and the antenna 10*a* of the ground wireless communication device 10 is installed at such a position as not to obstruct the running of the vehicle 100. Further, a reflective member (e.g., a reflective plate) is preferably installed on the front the vehicle 100 in order to reflect a distance measurement electromagnetic wave transmitted from the ground wireless communication device 10. When the front of the vehicle 100 is stopped at a stop sign 50*a*, the antenna 10*a* and the antenna 110*a* are positioned at a predetermined distance from each other.

FIG. 2 (*b*) illustrates the reception strength of an electromagnetic wave received by the ground wireless communication device 10 (i.e., the reception strength of a signal received from the on-vehicle communication device 110). The reception strength may be an index reflective of a distance. For example, a received signal strength indicator (RSSI) or a received electric field strength may be used as the reception strength.

The vehicle 100 pulling in to the station platform 50 runs at a speed of 80 to 60 km/h until it reaches a position approximately 200 m from the stop sign 50*a*, and continues to run at a speed of 60 to 10 km/h until it reaches a position approximately 20 m from the stop sign 50*a*. During such a run, the ground wireless communication device 10 continuously performs data transmission (data communication) to the on-vehicle wireless communication device 110 (first mode) until the reception strength of an electromagnetic wave transmitted from the on-vehicle wireless communication device 110 of the vehicle 100 is equal to or greater than a predetermined value (first value). That is to say, the reception strength of an electromagnetic wave transmitted from the on-vehicle wireless communication device 110 reaches the first value at a distance of approximately 20 m from the stop sign.

When the reception strength of an electromagnetic wave from the on-vehicle wireless communication device 110 is equal to or greater than the first value, the ground wireless communication device 10 transitions to the radar mode (second mode), that is, transitions from the data transmission operation to the radar operation, and functions as a distance measurement radar. That is to say, the ground wireless communication device 10 remains in the radar mode until the vehicle 100 runs at a speed of 10 to 0 km/h to the position of the stop sign 50*a* in order to transmit a radar electromagnetic wave toward the vehicle 100.

The radar electromagnetic wave is repeatedly transmitted at extremely short intervals until the vehicle 100 comes to a stop. During such a period, the distance to the vehicle 100 is repeatedly measured. The distance measured until the vehicle 100 comes to a stop gradually becomes shorter. When the vehicle 100 stops, the measured distance does not change. Thus, the ground wireless communication device 10 determines the resulting state as a stopped state. In the stopped state, the ground wireless communication device 10 reverts to a data transmission mode and transmits data to the on-vehicle wireless communication device 110 (third mode).

During a data transmission in the third mode, for example, door opening or door closing instruction information for the movable fence device 30, which is transmitted from the vehicle 100, is wirelessly transmitted from the on-vehicle wireless communication device 110 to the ground wireless communication device 10 and then transmitted from the ground wireless communication device 10 to the control device 40. Based on the received door opening or door closing instruction information, the control device 40 opens or closes the door of the movable fence device 30.

Further, when, for example, an image showing an open/closed state of the door of the movable fence device 30 on the station platform 50 is captured by the surveillance camera 20, the resulting image information is transmitted from the surveillance camera 20 to the ground wireless communication device 10 through the control device 40 and then wirelessly transmitted from the ground wireless communication device 10 to the on-vehicle communication device 110. The image information received by the on-vehicle wireless communication device 110 is transmitted to the operation/display device 120 in the vehicle 100 and displayed. The train driver 120*a* then checks the displayed image information to any abnormality.

When, in the third mode, the vehicle 100 resumes its running and enters a movement state, the antenna 110*a* of the on-vehicle wireless communication device 110 passes through the position of the antenna 10*a* of the ground wireless communication device 10. Then, the ground wireless communication device 10 is unable to receive an electromagnetic wave from the on-vehicle wireless communication device 110 so that the reception strength of an electromagnetic wave received by the ground wireless communication device 10 is equal to or smaller than a predetermined second value (e.g., zero). When the reception strength is equal to or smaller than the second value, the ground wireless communication device 10 reverts to the aforementioned first mode.

Figure 3:
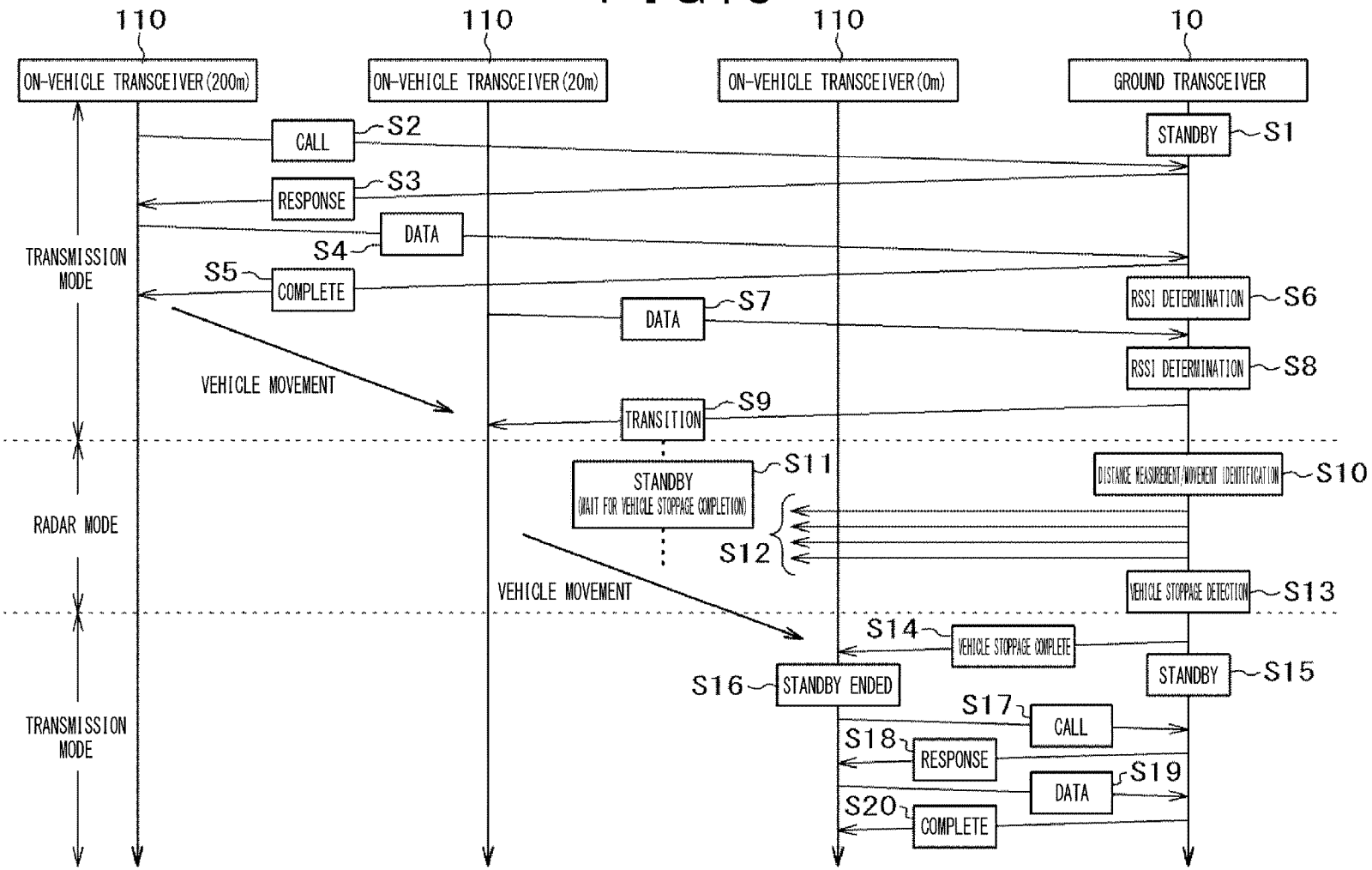
FIG. 3 is a communication sequence diagram of the wireless communication system according to the embodiment of the present invention.

FIG. 3 is a communication sequence diagram of the wireless communication system according to the embodiment of the present invention.

In the present embodiment, frequencies used by the wireless communication system are such that one transmission frequency and one reception frequency are used both by the ground wireless communication device 10 on the station side and the on-vehicle wireless communication device 110 on the vehicle side, and that an electromagnetic wave in the 60 GHz band (e.g., a 60 GHz electromagnetic wave) is used. Using an electromagnetic wave in the 60 GHz band makes it easy to perform both data transmission and distance measurement. An electromagnetic wave other than the electromagnetic wave in the 60 GHz band, such as an electromagnetic wave in the 24 GHz band or in the 76 GHz band, may also be used.

As illustrated in FIG. 3, the initial state of the ground wireless communication device 10 is a standby state (step S1) in the first mode. The example depicted in FIG. 3 indicates a method that is performed by the on-vehicle wireless communication device 110 to call the ground wireless communication device 10 by using a polling call signal (step S2) and communicatively connect to the ground wireless communication device 10 that has responded by using a polling response signal (step S3).

FIGS. 4 (*a*) to 4 (*d*) illustrate communication formats of the wireless communication system according to the embodiment of the present invention.

FIG. 4 (*a*) illustrates a format of the polling call signal. The format includes a device number, a train number, and data. The device number is an identifier that identifies the on-vehicle wireless communication device 110 acting as a transmitting end. The train number identifies the vehicle 100. The data includes a command (data response request) that requests the ground wireless communication device 10 to return data.

FIG. 4 (*b*) illustrates a format of the polling response signal. The format includes a device number, a station number, a platform number, and data. The device number is an identifier that identifies the ground wireless communication device 10 acting as a transmission end. The station number is an identifier that identifies a station where the ground wireless communication device 10 is disposed. The platform number is an identifier that identifies a platform where the ground wireless communication device 10 is disposed. The data includes an ACK response to the command (data response request) of the polling call signal. The ACK response indicates that the preparation for response data transmission is ended.

FIG. 4 (*c*) illustrates a format of a data transmission signal that is to be transmitted from the on-vehicle wireless communication device 110 to the ground wireless communication device 10. The format includes a device number, a train number, a device condition, and transmission data. The device number is an identifier that identifies the on-vehicle wireless communication device 110. The train number is an identifier that identifies the vehicle 100.

FIG. 4 (*d*) illustrates a format of a data transmission signal that is to be transmitted from the ground wireless communication device 10 to the on-vehicle wireless communication device 110. The format includes a device number, a station number, a platform number, a device condition, and transmission data. The device number is an identifier that identifies the ground wireless communication device 10 acting as a transmitting end. The station number is an identifier that identifies a station where the ground wireless communication device 10 is disposed. The platform number is an identifier that identifies a platform where the ground wireless communication device 10 is disposed.

In the above-described manner, a wireless link is established between the on-vehicle wireless communication device 110 and the ground wireless communication device 10. The polling call signal is transmitted repeatedly and successively in order to verify that the wireless link is established. The polling call signal is also transmitted during an interval between intermittent data transmissions.

Referring to FIG. 3, while the distance between the vehicle 100 and the stop sign 50*a* is approximately 200 m to 20 m (i.e., in the first mode), the on-vehicle wireless communication device 110 in the first mode enters the standby state where the polling call signal "CALL" (step S2) having the format illustrated in FIG. 4 (*a*) is transmitted repeatedly and intermittently to wait for the polling response signal "RESPONSE" (step S3) from the ground wireless communication device 10.

Upon receipt of "CALL" (step S2) from the on-vehicle wireless communication device 110, based on information included in the polling call signal, the ground wireless communication device 10 recognizes the device number of the on-vehicle wireless communication device 110, which is a communication partner, also recognizes the train number, and verifies the validity of the on-vehicle wireless communication device 110. When the on-vehicle wireless communication device 110 is determined to be valid, the ground wireless communication device 10 exits the standby state and transmits, in the format illustrated in FIG. 4 (*b*), the polling response signal "RESPONSE" (step S3) indicating that the preparation for data transmission is completed.

Upon receipt of the polling response signal "RESPONSE", based on information included in the polling response signal, the on-vehicle wireless communication device 110 recognizes the device number of the ground wireless communication device 10, which is a communication partner, also recognizes the station number and the platform number, and verifies the validity of the ground wireless communication device 10. When the ground wireless communication device 10 is determined to be valid, the on-vehicle wireless communication device 110 transmits data in the format illustrated in FIG. 4 (*c*) to the ground wireless communication device 10 (step S4). The data includes a command indicative of process continuation.

Upon receipt of data from the on-vehicle wireless communication device 110, the ground wireless communication device 10 transmits data "COMPLETE" (step S5) by using the data transmission format illustrated in FIG. 4 (*d*). The data "COMPLETE" indicates that the step S4 data is received.

After the transmission of the data "COMPLETE" (step S5), the on-vehicle wireless communication device 110 and the ground wireless communication device 10 repeat a transmission mode communication protocol between polling transmission (step S2) and data "COMPLETE" (step S5). The first mode persists until the vehicle 100 reaches a position that is approximately 20 m from the stop sign 50*a*. In the first mode, upon receipt of data from the on-vehicle wireless communication device 110, the ground wireless communication device 10 determines whether the reception strength (reception level) is equal to or higher than the predetermined value (first value) (step S6).

When the reception strength is equal to the first value, the vehicle 100 is positioned at a distance of approximately 20 m from the stop sign 50*a*. The greater the reception strength, the closer to the stop sign 50*a* the vehicle 100 is. The relationship between the reception strength and the position of the vehicle 100 should be measured beforehand.

Distance measurement based on the reception strength is lower in accuracy than distance measurement in the radar mode. In the present embodiment, the accuracy of stoppage detection and distance measurement is increased by making distance measurements in the radar mode when the vehicle 100 is close to a stop position.

When, in the first mode, the reception strength of the polling call signal or transmission data (step S7) from the on-vehicle wireless communication device 110 is equal to or greater than the first value (RSSI determination in step S8), that is, when the distance between the vehicle 100 and the stop sign 50*a* is equal to or shorter than approximately 20 m, the ground wireless communication device 10 not only transmits a mode transition request (step S9), which makes a request for transitioning to the radar mode, to the on-vehicle wireless communication device 110 by using the data transmission format illustrated in FIG. 4 (*d*), but also transitions to the radar mode (second mode). That is to say, the ground wireless communication device 10 starts a distance measurement operation (radar operation) in order to measure the distance to the vehicle 100 (step S10).

Upon receipt of the mode transition request (strep S9), the on-vehicle wireless communication device 110 transitions to the second mode, stops the transmission of the polling call signal, and enters the standby state (step S11).

After transitioning to the radar mode, the ground wireless communication device 10 performs the radar operation until the vehicle 100 approaches the stop sign 50*a* and comes to a stop. During the radar operation, the ground wireless communication device 10 repeatedly transmits an electromagnetic wave (step S12) and detects the reflection of the transmitted electromagnetic wave until the distance between the vehicle 100 and the stop sign 50*a* is decreased to a predetermined value (i.e., until the stoppage of the vehicle 100 is determined).

When the vehicle 100 comes to a stop, the distance detected by the ground wireless communication device 10 does not vary due to a repeated radar operation. Thus, the ground wireless communication device 10 detects that the vehicle 100 is stopped (step S13). Further, the ground wireless communication device 10 detects the stop position of the vehicle 100 by measuring the distance to the vehicle 100.

Upon detection of the stoppage of the vehicle 100, the ground wireless communication device 10 stops its radar operation, transitions to the third mode, and transmits "STOPPAGE COMPLETE" data to the on-vehicle wireless communication device 110, which is in the standby state (step S11), by using the data transmission format illustrated in FIG. 4 (*d*) (step S14). That is to say, the ground wireless communication device 10 transmits a control signal that causes the on-vehicle wireless communication device 110 to revert to the data transmission mode. Subsequently, the ground wireless communication device 10, which is now placed in the third mode, enters the standby state to wait for transmission data to be transmitted from the on-vehicle wireless communication device 110 (step S15).

Upon receipt of the "STOPPAGE COMPLETE" data, the on-vehicle wireless communication device 110 exits the standby state (step S16) and transitions to the third mode. Then, as is the case with steps S2 to S5, the on-vehicle wireless communication device 110 repeats steps S17 (polling call signal "CALL") to S20 (data transmission "COMPLETE").

Stop position information about the vehicle 100, which is acquired in step S13, is transmitted from the ground wireless communication device 10 to the on-vehicle wireless communication device 110 and/or the control device 40. The stop position information is transmitted to the on-vehicle wireless communication device 110 when data is transmitted in step S20. The on-vehicle wireless communication device 110 and the control device 40 determine whether the stop position of the vehicle 100 is within a permissible range, and also determine the degree of deviation from a correct stop position. Then, in the third mode, the ground wireless communication device 10 transmits an image captured by the surveillance camera 20 to the on-vehicle wireless communication device 110.

Subsequently, when the stopped vehicle 100 departs to disable the on-vehicle wireless communication device 110 from communicating with the ground wireless communication device 10, the ground wireless communication device 10 does not transmit the polling response signal "RESPONSE" for a continued period of time in response to the polling call signal "CALL" from the on-vehicle wireless communication device 110. If this state persists for a predetermined period of time, the on-vehicle wireless communication device 110 recognizes the end of the communication with the ground wireless communication device 10, which has been a communication partner, resets the information about the ground wireless communication device 10 (the device number of the ground wireless communication device 10, the station number, and the platform number), and transitions to the first mode. The on-vehicle wireless communication device 110 then repeatedly performs a "CALL" operation by using the polling call signal.

Further, the ground wireless communication device 10 remains in a state where it is unable to receive the polling call signal from the on-vehicle wireless communication device 110. If this state persists for a predetermined period of time, ground wireless communication device 10 recognizes the end of the communication with the on-vehicle wireless communication device 110, which has been a communication partner, resets the information about the on-vehicle wireless communication device 110 (the device number of the on-vehicle wireless communication device 110 and the station number), and transitions to the first mode. The ground wireless communication device 10 then enters the standby state to wait for the polling call signal.

When the vehicle 100 does not stop and passes through the station platform 50, the ground wireless communication device 10 is unable to detect the stoppage of the vehicle 100. Thus, the ground wireless communication device 10 does not transition from the second mode to the third mode. When the vehicle 100 passes through the station platform 50, the ground wireless communication device 10 is unable to detect a wave reflected from the vehicle 100. If, in the second mode, the ground wireless communication device 10 is persistently unable to detect a wave reflected from the vehicle 100 for a predetermined period of time, the ground wireless communication device 10 determines that the vehicle 100 has passed through the station platform 50, and then transitions from the second mode to the first mode.

Meanwhile, if, in the second mode, the on-vehicle wireless communication device 110, which is disposed on the vehicle 100 that has passed through, is persistently unable to receive the "STOPPAGE COMPLETE" data (step S14) from the ground wireless communication device 10 for at least a predetermined period of time, the on-vehicle wireless communication device 110 determines that the vehicle 100 has passed through the station platform 50, resets the information about the ground wireless communication device 10, which has been a communication partner, and transitions from the second mode to the first mode.

Figure 5:
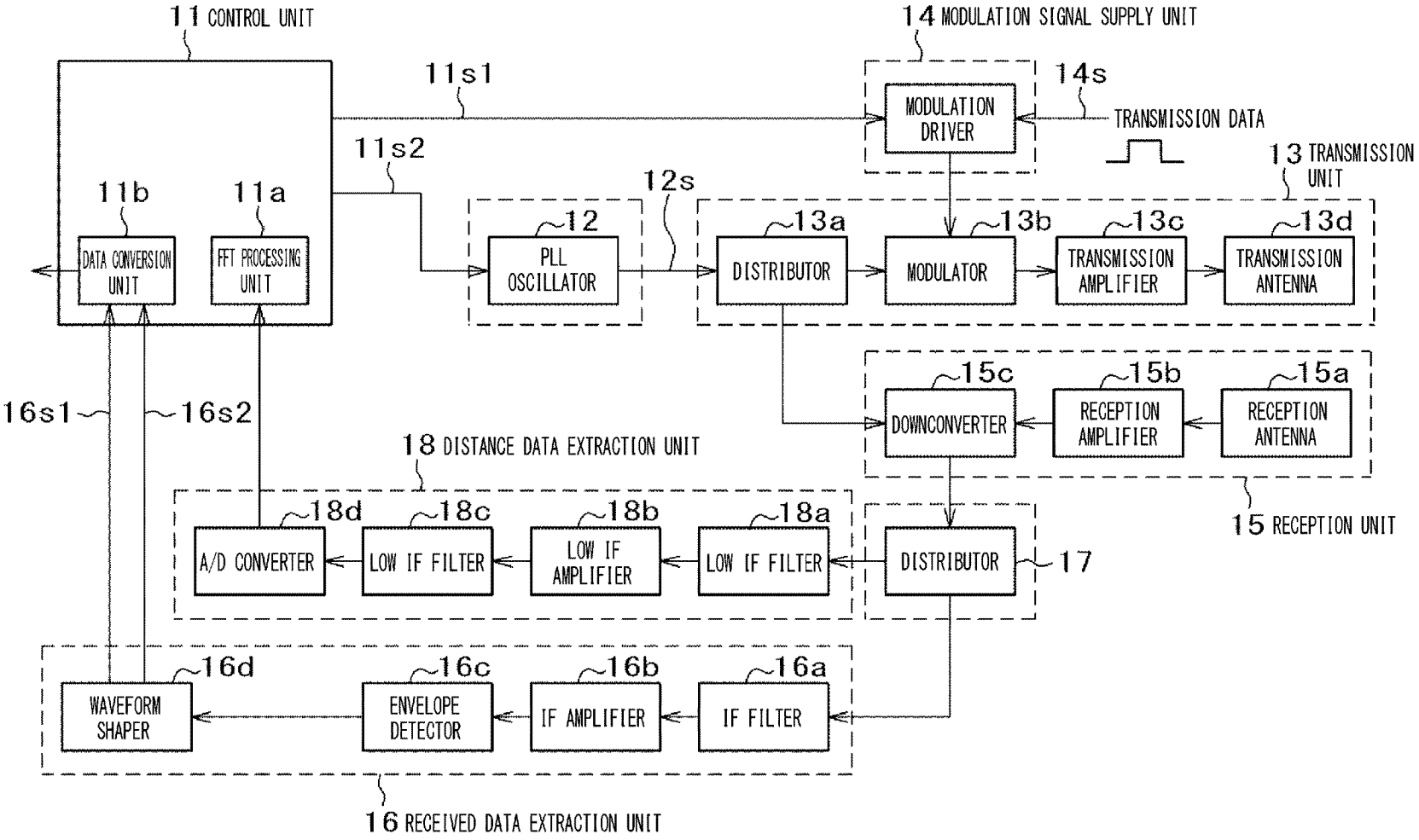
FIG. 5 is a diagram illustrating a configuration of a ground wireless communication device according to the embodiment of the present invention.

FIG. 5 is a diagram illustrating a configuration of the ground wireless communication device according to the embodiment of the present invention.

The ground wireless communication device 10 includes a control unit 11, an oscillation unit 12, a transmission unit 13, a modulation signal supply unit (modulation driver) 14, a reception unit 15, a received data extraction unit 16, a distance data extraction unit 18, and a distributor 17. The control unit 11 controls the ground wireless communication device 10 and processes various data. The oscillation unit 12 generates a carrier frequency signal. The transmission unit 13 transmits the carrier frequency signal and an outgoing signal. The modulation signal supply unit (modulation driver) 14 supplies a modulation signal based on transmission data (NRZ (Non-Return-to-Zero) signal in the present example) to the transmission unit 13. The reception unit 15 receives an incoming signal. The received data extraction unit 16 extracts received data from the incoming signal received by the reception unit 15. The distance data extraction unit 18 extracts distance data from the incoming signal received by the reception unit 15. The distributor 17 distributes the incoming signal received by the reception unit 15 to the received data extraction unit 16 and the distance data extraction unit 18.

The oscillation unit 12 includes a PLL (Phase-Locked Loop) oscillator. A signal 11*s*2 from the control unit 11 exercises control to place the oscillation unit 12 in either the data transmission mode (first or third mode) or the radar mode (second mode). In the data transmission mode, the oscillation unit 12 maintains the carrier frequency so that the output frequency of the oscillation unit 12 is constant. That is to say, the oscillation unit 12 generates a carrier wave signal having a constant frequency. In the radar mode, the output frequency of the oscillation unit 12 is a triangular wave (having triangular time-frequency characteristics) depicted in later-described FIGS. 8 (*a*) and 8 (*b*). That is, the oscillation unit 12 generates a distance measurement signal whose frequency varies at fixed intervals.

The control unit 11 includes an FFT processing unit 11*a* and a data conversion unit 11*b*. In the radar mode, the FFT processing unit 11*a* calculates the distance between the on-vehicle wireless communication device 110 and the ground wireless communication device 10 on the basis of the distance data received by the reception unit 15 and extracted by the distance data extraction unit 18. In the data transmission mode, the data conversion unit 11*b* converts the received data, which is received by the reception unit 15 and extracted by the received data extraction unit 16, to data transmittable to an external device. The FFT processing unit 11*a* and the data conversion unit 11*b* may be formed as a signal processing FPGA.

The control unit 11 includes, as its hardware components, a CPU (Central Processing Unit) and a memory. The memory stores, for example, an operating program for the control unit 11. The CPU operates in accordance with the operating program.

The transmission unit 13 includes a distributor 13*a*, a modulator 13*b*, a transmission amplifier 13*c*, and a transmission antenna 13*d*. The distributor 13*a* distributes an output signal from the oscillation unit 12 to the modulator 13*b* and to a downconverter 15*c* as described later. The modulator 13*b* modulates the carrier frequency signal by using the modulation signal from the modulation signal supply unit 14. The transmission amplifier 13*c* amplifies an output signal from the modulator 13*b*.

The reception unit 15 includes a reception antenna 15*a*, a reception amplifier 15*b*, and the downconverter 15*c*. The reception amplifier 15*b* amplifies an output signal from the reception antenna 15*a*. The downconverter 15*c* eliminates the carrier frequency signal included in an output signal from the reception amplifier 15*b*.

A wireless transmission/reception unit is configured to include the transmission unit 13 and the reception unit 15. The wireless transmission/reception unit transmits data to the on-vehicle wireless communication device 110, and performs wireless transmission and reception in order to detect the stoppage of the vehicle 100.

The received data extraction unit 16 includes an IF filter 16*a*, an IF amplifier 16*b*, an envelope detector 16*c*, and a waveform shaper 16*d*. The IF filter 16*a* eliminates frequency components other than those required for received data extraction. The IF amplifier 16*b* amplifies an output signal from the IF filter 16*a*. The envelope detector 16*c* detects an envelope of an output signal from the IF amplifier 16*b*. The waveform shaper 16*d* shapes the waveform of an output signal from the envelope detector 16*c*.

The distance data extraction unit 18 includes a low IF filter 18*a*, a low IF amplifier 18*b*, a low IF filter 18*c*, and an A/D converter (analog-to-digital converter) 18*d*. The low IF filter 18*a* eliminates frequency components other than those required for distance data extraction. The low IF amplifier 18*b* amplifies an output signal from the low IF filter 18*a*. The low IF filter 18*c* further eliminates extra frequency components. The A/D converter 18*d* digitizes an analog signal.

In the present embodiment, the on-vehicle wireless communication device 110 does not require a distance measurement function. Therefore, the on-vehicle wireless communication device 110 may be implemented by removing the distance data extraction unit 18, the distributor 17, and the FFT processing unit 11*a* from the above-described configuration of the on-vehicle wireless communication device 110.

Figure 6:
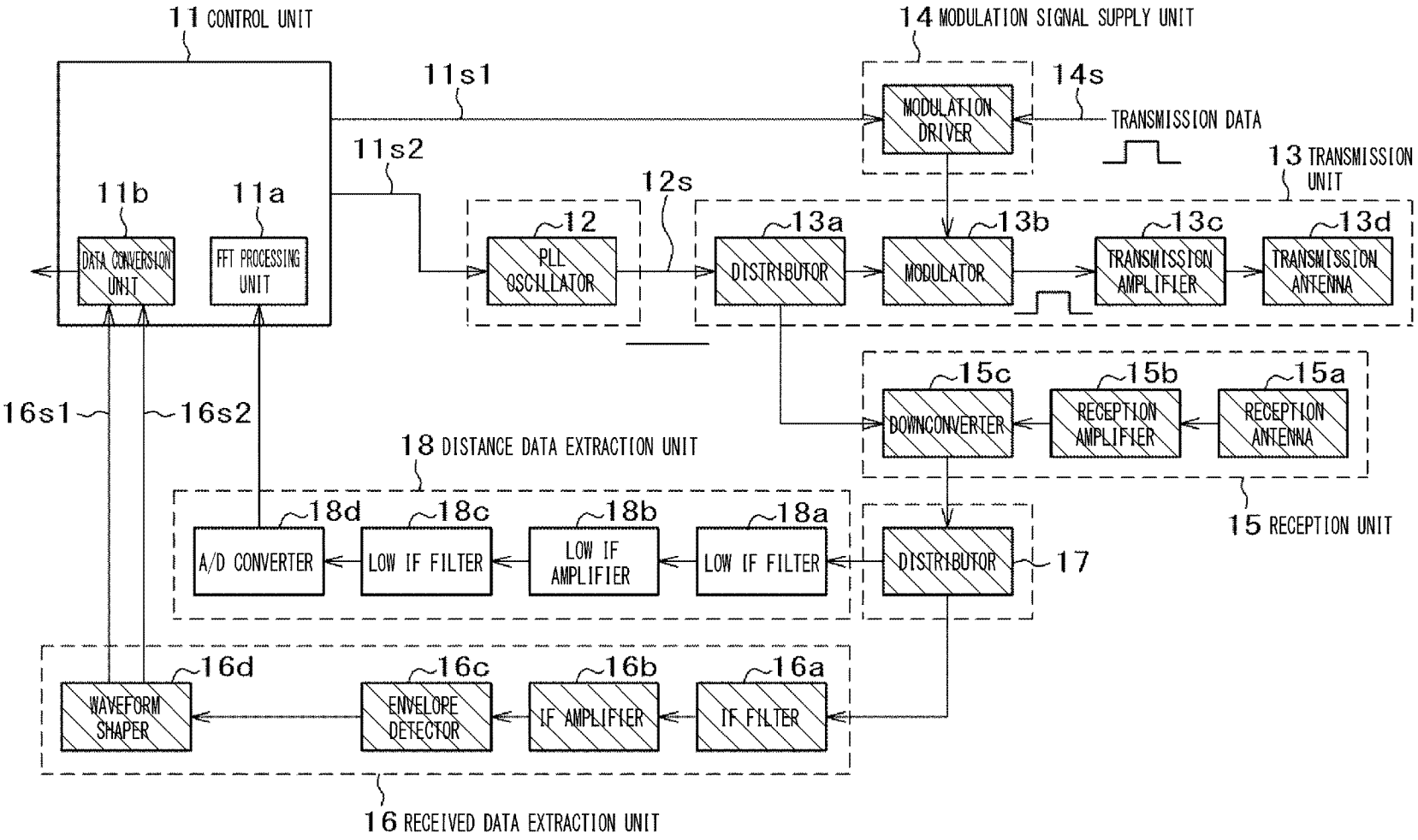
FIG. 6 is a diagram illustrating a data transmission operation of the ground wireless communication device according to the embodiment of the present invention.

FIG. 6 is a diagram illustrating the data transmission operation of the ground wireless communication device according to the embodiment of the present invention. First of all, a transmission operation for data transmission in the first and third modes will be described.

When the control unit 11 selects the data transmission mode (e.g., ASK modulation mode), the control unit 11 outputs a signal 11*s*1 and a signal 11*s*2 that are at the "L" level. The signal 11*s*1 transmits "L" level information to the modulation driver 14. Upon receipt of the "L" level information, the modulation driver 14 supplies a modulation signal to the modulator 13*b*. The modulator 13*b* then uses the supplied modulation signal to modulate an inputted signal.

Further, the signal 11*s*2 transmits "L" level information to the oscillation unit 12. Upon receipt of the "L" level information, the oscillation unit 12 generates a carrier frequency signal having a constant frequency. The generated carrier frequency signal is inputted to the distributor 13*a*, and an output from the distributor 13*a* is distributed to two circuits. One of the distributed carrier frequency signals is inputted to the modulator 13*b*. An output from the modulator 13*b* is amplified to a predetermined value by the transmission amplifier 13*c* and then radiated from the transmission antenna 13*d*. In such an instance, the modulator 13*b* modulates the carrier frequency signal without attenuating its level or after attenuating its level in compliance with the NRZ signal inputted to the modulation driver 14. The NRZ signal is used as the transmission data. The above series of operations is the transmission operation for data transmission based on an ASK modulation method.

A reception operation for data transmission in the first and third modes will now be described.

A radio wave transmitted from the on-vehicle wireless communication device 110 is received by the reception antenna 15*a*, amplified to a predetermined value by the reception amplifier 15*b*, and inputted to the downconverter 15*c*. The radio wave is then mixed with a signal outputted from the distributor 13*a* (the other one of the distributed carrier frequency signals) in the downconverter 15*c*, and inputted to the distributor 17. The received signal distributed from the distributor 17 is inputted to the IF filter 16*a*, shaped to retain only required band components, and amplified to a predetermined level by the IF amplifier 16*b*. The received signal amplified by the IF amplifier 16*b* is forwarded to the envelope detector 16*c* and the waveform shaper 16*d* in order to extract data. The extracted data is outputted, as a signal 16*ds*1, to the data conversion unit 11*b* in the control unit 11, converted to a data transmission interface by the data conversion unit 11*b*, and transmitted to the external device from the ground wireless communication device 10.

Further, the control unit 11 determines the level of a signal received by the ground wireless communication device 10, that is, the reception strength, by using a signal 16*ds*2 inputted from the waveform shaper 16*d*. In the first mode, the control unit 11 determines whether the reception strength is equal to or greater than the first value. If the reception strength is determined to be neither equal to nor greater than the first value, the control unit 11 remains in the data transmission mode (first mode) and repeatedly receives a signal and determines the reception strength. If the reception strength is determined to be equal to or greater than the first value, the control unit 11 transitions to the radar mode (second mode), and the signal 11*s*1 and the signal 11*s*2 outputted from the control unit 11 are set at the "H" level.

In the third mode, the control unit 11 determines whether the reception strength is equal to or smaller than the second value. If the reception strength is determined to be neither equal to nor smaller than the second value, the control unit 11 remains in the data transmission mode (third mode), and repeatedly receives a signal and determines the reception strength. If the reception strength is determined to be equal to or smaller than the second value, the control unit 11 transitions from the third mode to the first mode.

In the present embodiment, the operation performed in the data transmission mode (first or third mode) by the on-vehicle wireless communication device 110 is the same as the above-described operation of the ground wireless communication device 10. However, the on-vehicle wireless communication device 110 does not need to determine whether the reception strength is equal to or greater than the first value and whether the reception strength is equal to or smaller than the second value.

Figure 7:
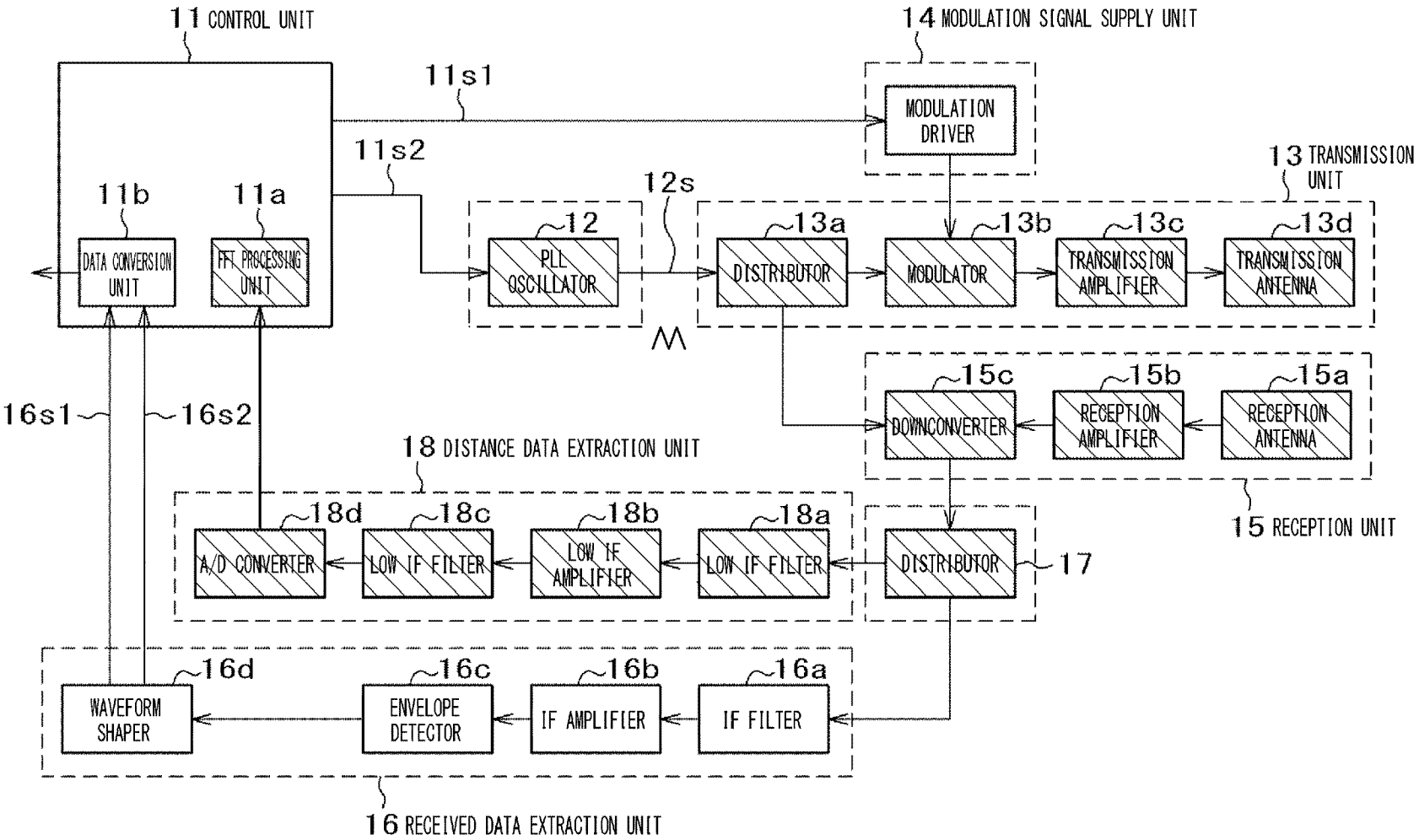
FIG. 7 is a diagram illustrating a distance measurement operation of the ground wireless communication device according to the embodiment of the present invention.

FIG. 7 is a diagram illustrating the distance measurement operation of the ground wireless communication device according to the embodiment of the present invention. First of all, a transmission operation for distance measurement in the second mode will be described.

When the control unit 11 selects the radar mode, the control unit 11 outputs the signal 11*s*1 and the signal 11*s*2 that are at the "H" level. The signal 11*s*1 transmits "H" level information to the modulation driver 14. Upon receipt of the "H" level information, the modulation driver 14 stops the supply of the modulation signal to the modulator 13*b*, which is based on the transmission data. The modulator 13*b* then allows a signal inputted from the distributor 13*a* to pass through as is.

Further, the signal 11*s*2 transmits "H" level information to the oscillation unit 12. Upon receipt of the "H" level information, the oscillation unit 12 generates a carrier signal whose frequency is swept at fixed intervals (see ft in FIG. 8). The generated swept frequency is inputted to the distributor 13*a*. An output from the distributor 13*a* is distributed to two circuits. One of the swept frequency signals is inputted to the modulator 13*b*. An output from the modulator 13*b* is amplified to a predetermined value by the transmission amplifier 13*c* and then radiated from the transmission antenna 13*d*. In such an instance, the modulator 13*b* allows the inputted swept frequency signal to pass through without attenuating it. The above series of operations is the transmission operation for measuring the distance to the vehicle 100.

A reception operation for distance measurement in the second mode will now be described.

A radio wave reflected from the on-vehicle wireless communication device 110 is received by the reception antenna 15*a*, amplified to a predetermined value by the reception amplifier 15*b*, and inputted to the downconverter 15*c*. The radio wave is then mixed with a signal outputted from the distributor 13*a* (the other one of the distributed swept frequency signals) in the downconverter 15*c*, and inputted to the distributor 17. The received signal distributed from the distributor 17 is inputted to the low IF filter 18*a*, shaped to retain only required band components, and amplified to a predetermined level by the low IF amplifier 18*b*. The received signal amplified by the low IF amplifier 18*b* is forwarded to the low IF filter 18*c* in order to eliminate extra frequency components, and then digitized by the A/D converter 18*d*. Based on an output from the A/D converter 18*d*, the FFT processing unit 11*a* in the control unit 11 calculates the distance between the vehicle 100 and the ground wireless communication device 10.

The control unit 11 checks the distances calculated by the FFT processing unit 11*a* to determine whether the difference between the last calculated distance and the currently calculated distance is zero (0), that is, whether the vehicle 100 is stopped. If it is determined that the vehicle 100 is not stopped, the control unit 11 remains in the radar mode and repeats the distance measurement operation (transmission and reception operations for distance measurement). If it is determined that the vehicle 100 is stopped, the control unit 11 transitions to the data transmission mode (third mode) so that the signal 11*s*1 and the signal 11*s*2 outputted from the control unit 11 are set at the "L" level. Further, if the control unit 11 is unable to detect a wave reflected from the vehicle 100, the control unit 11 determines that the vehicle 100 has passed through the station platform 50, and then transitions from the radar mode (second mode) to the data transmission mode (first mode).

Figure 8:
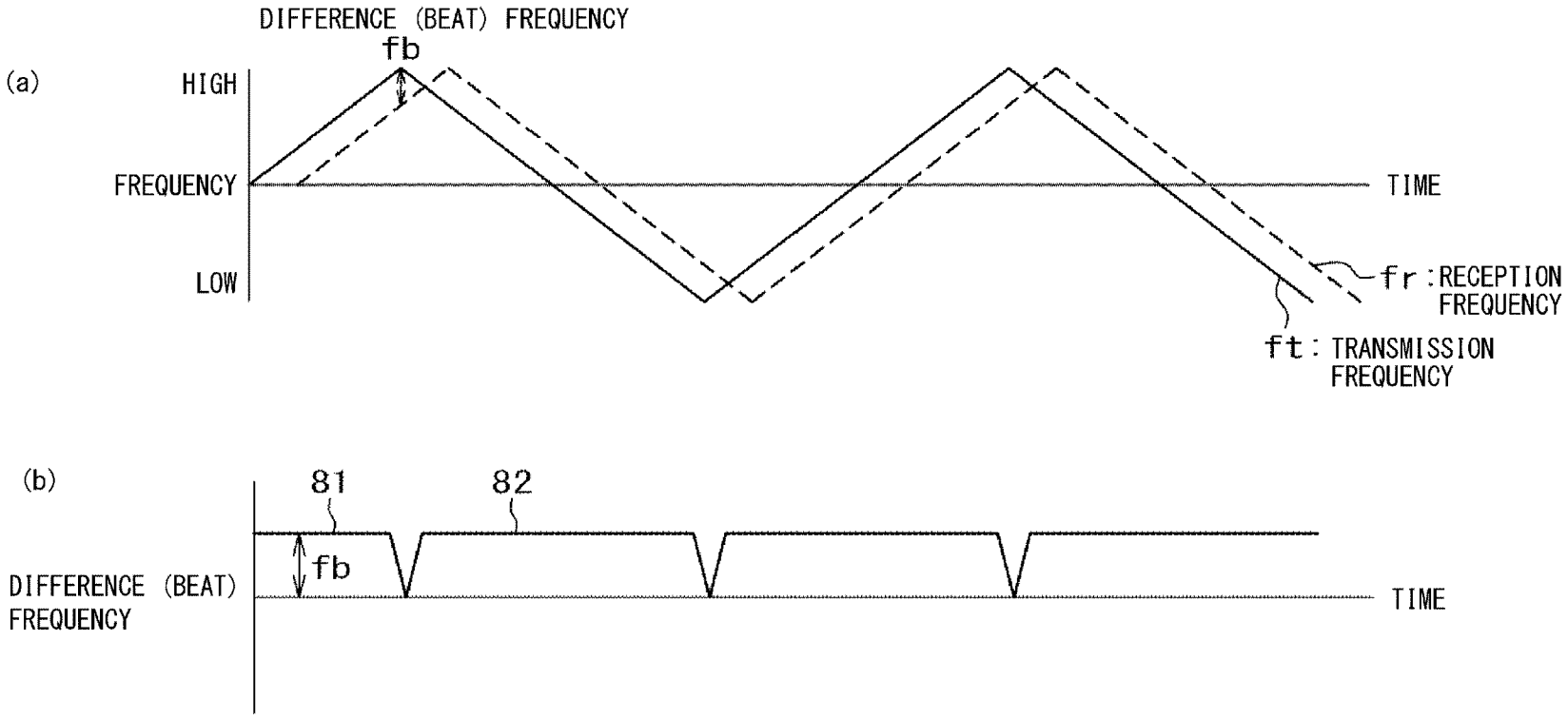
FIGS. 8 (*a*) and 8 (*b*) are diagrams illustrating a vehicle stop state detection process and a distance measurement process.

FIGS. 8 (*a*) and 8 (*b*) are diagrams illustrating a vehicle stop state detection process and a distance measurement process that are performed in the radar mode by the ground wireless communication device 10.

FIG. 8 (*a*) depicts a transmission frequency ft and a reception frequency fr. The transmission frequency ft is the frequency of a signal that is wirelessly transmitted from the ground wireless communication device 10 while the vehicle 100 is stopped. The reception frequency fr is a signal frequency that prevails when an outgoing signal having the frequency ft is reflected from the vehicle 100 and received by the ground wireless communication device 10. The vertical axis in FIG. 8 (*a*) represents frequency, and the horizontal axis represents the lapse of time. As illustrated in FIG. 8 (*a*), there is a time lag between the transmission of an outgoing signal having the frequency ft and the subsequent reception of an incoming signal having the frequency fr. Therefore, a difference (beat) frequency fb arises between the transmission frequency ft and the reception frequency fr.

FIG. 8 (*b*) illustrates temporal changes in the difference frequency fb. The vertical axis in FIG. 8 (*b*) represents the magnitude of the difference frequency fb, and the horizontal axis represents the lapse of time. As illustrated in FIG. 8 (*b*), while the vehicle 100 is stopped, the difference frequency fb periodically decreases at an intersection point depicted in FIG. 8 (*a*) between the transmission frequency ft and the reception frequency fr. At the other points, however, the difference frequency fb maintains a constant magnitude. Therefore, for example, in FIG. 8 (*b*), the difference frequency fb at 81 has the same magnitude as the difference frequency fb at 82. That is to say, as far as the magnitude of the difference frequency fb remains unchanged at almost all times although it periodically decreases, can be determined that the vehicle 100 is stopped.

Further, the magnitude of the difference frequency fb is proportional to the time interval between the transmission of an outgoing signal having the frequency ft and the reception of an incoming signal having the frequency fr. That is, the magnitude of the difference frequency is proportional to the distance between the vehicle 100 and the ground wireless communication device 10. Therefore, the distance between the vehicle 100 and the ground wireless communication device 10 can be calculated based on the magnitude of the difference frequency. The relationship between the frequency difference fb and the distance from the vehicle 100 to the ground wireless communication device 10 should be determined beforehand by making measurements.

Figure 9:
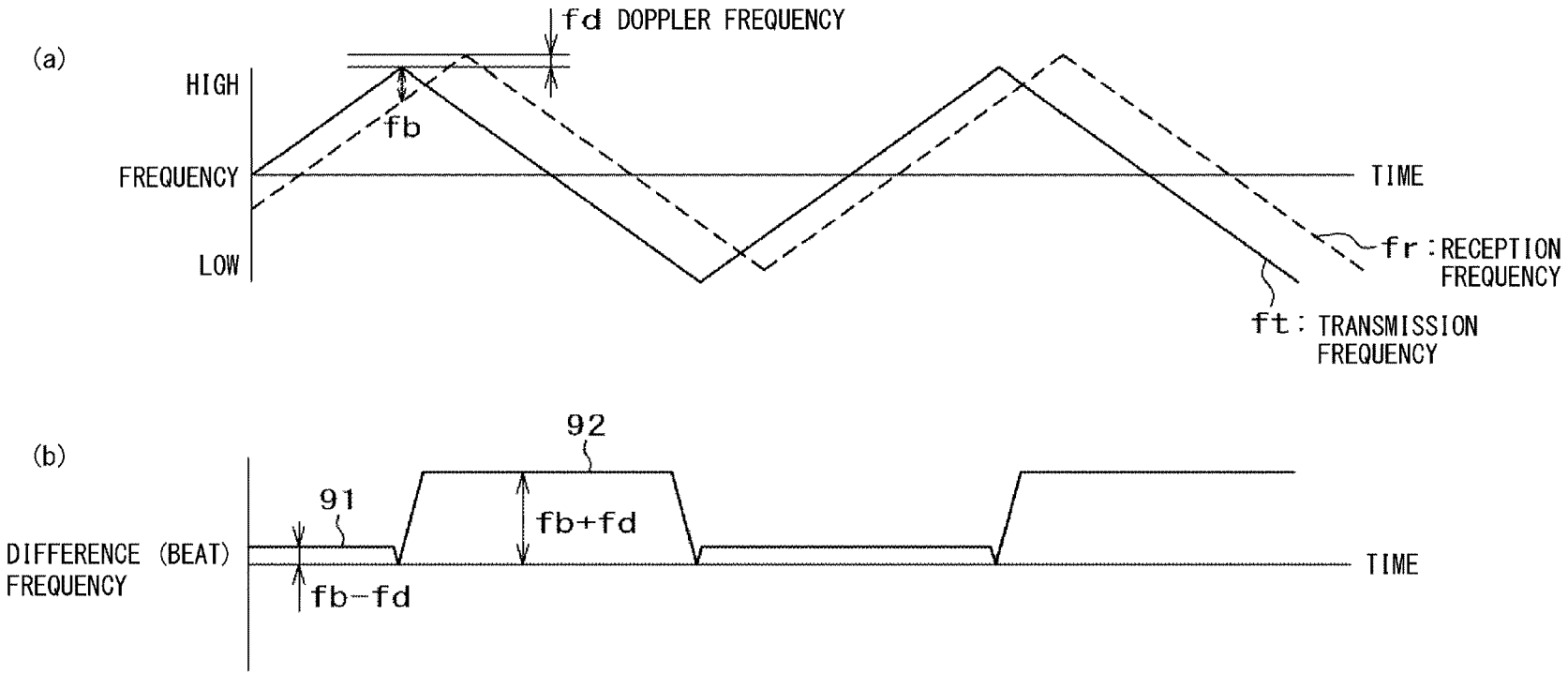
FIGS. 9 (*a*) and 9 (*b*) are diagrams illustrating a vehicle movement state detection process and a distance measurement process.

FIGS. 9 (*a*) and 9 (*b*) are diagrams illustrating a vehicle movement state detection process and a distance measurement process that are performed in the radar mode by the ground wireless communication device 10.

FIG. 9 (*a*) depicts a transmission frequency ft and a reception frequency fr. The transmission frequency ft is the frequency of a signal that is wirelessly transmitted from the ground wireless communication device 10 while the vehicle 100 is moving. The reception frequency fr is a signal frequency that prevails when an outgoing signal having the frequency ft is reflected from the vehicle 100 and received by the ground wireless communication device 10. The vertical axis in FIG. 9 (*a*) represents frequency, and the horizontal axis represents the lapse of time. As illustrated in FIG. 9 (*a*), there is a time lag between the transmission of an outgoing signal having the transmission frequency ft and the subsequent reception of an incoming signal having the reception frequency fr. Thus, a difference frequency arises between the transmission frequency ft and the reception frequency fr due to a frequency difference fb caused by the time lag and due to a frequency difference fd (Doppler shift frequency) that is caused by the Doppler effect when the vehicle 100 approaches the ground wireless communication device 10.

FIG. 9 (*b*) illustrates temporal changes in the difference frequency. The vertical axis in FIG. 9 (*b*) represents the magnitude of the difference frequency, and the horizontal axis represents the lapse of time. As illustrated in FIG. 9 (*b*), while the vehicle 100 is moving, the difference frequency is small when the transmission frequency rises as indicated by a triangular waveform, and is great when the transmission frequency lowers. Therefore, for example, in FIG. 9 (*b*), the difference frequency at 91 differs in magnitude from the difference frequency at 92. That is to say, when the magnitude of the difference frequency periodically varies, it can be determined that the vehicle 100 is moving.

Further, as mentioned earlier, the distance between the vehicle 100 and the ground wireless communication device 10 can be calculated based on the magnitude of the difference frequency. While the vehicle 100 is moving, the frequency difference fb caused by a time lag can be obtained, for example, by adding the magnitude of the difference frequency at 91 in FIG. 9 (*b*) to the magnitude of the difference frequency at 92 and dividing the addition result by two. Based on the obtained frequency difference fb, the distance between the vehicle 100 and the ground wireless communication device 10 can be obtained.

If the currently measured distance is different from the last measured distance, it can be determined that the vehicle 100 is moving. If, by contrast, the currently measured distance is the same as the last measured distance, it can be determined that the vehicle 100 is stopped.

As described above, the distance between the vehicle 100 and the ground wireless communication device 10 can be calculated based on the magnitude of the difference frequency fb. Further, whether the vehicle 100 is moving or stopped can be determined based on the difference between the last measured distance and the currently measured distance or on temporal changes in the magnitude of the difference frequency fb. In the present embodiment, whether the vehicle 100 is moving or not is determined based on the distance between the last measured distance and the currently measured distance.

Figure 10:
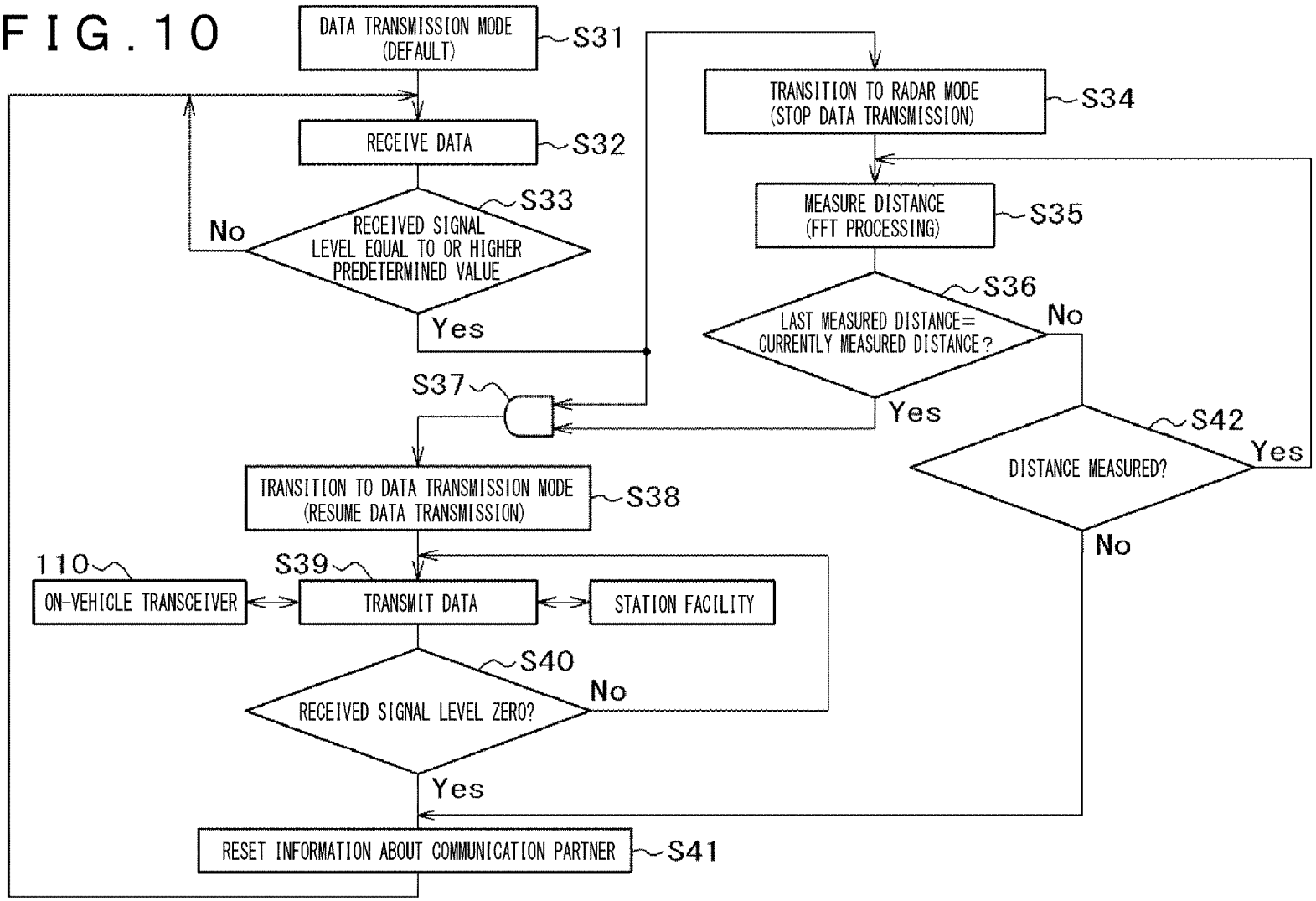
FIG. 10 is a diagram illustrating a process performed by the ground wireless communication device according to the embodiment of the present invention.

FIG. 10 is a diagram illustrating a process performed by the ground wireless communication device according to the embodiment of the present invention. The process is controlled by the control unit 11.

In the power-on state (default), the ground wireless communication device 10 starts operating in the data transmission mode (first mode) (step S31 in FIG. 10). In the data transmission mode, the control unit 11 operates the received data extraction unit 16 to perform a data conversion process. When wireless transmission/reception starts between the ground wireless communication device 10 and the on-vehicle wireless communication device 110 and the ground wireless communication device 10 receives data (step S32), the control unit 11 determines whether the level of the output signal 16*ds*2 from the waveform shaper 16*d*, that is, a received signal level indicative of the reception strength, is equal to or higher than the predetermined first value (step S33). Here, the data reception includes the reception of the polling call signal.

If, in this instance, the ground wireless communication device 10 and the on-vehicle wireless communication device 110 are at a long distance from each other, the received signal level is low. If the received signal level is neither equal to nor higher than the first value (the query in step S33 is answered "NO"), the control unit 11 returns to step S32, and then repeatedly receives data (step S32) and checks the received signal level (step S33) until the received signal level is equal to or higher than the first value, that is, the distance between the ground wireless communication device 10 and the on-vehicle wireless communication device 110 is equal to or shorter than a predetermined value.

In the first mode, as described above, the ground wireless communication device 10 transmits data to the on-vehicle wireless communication device 110 and determines whether the reception strength of a received signal is equal to or higher than the first value. During such a data transmission (first mode), various data are wirelessly transmitted between the on-vehicle wireless communication device 110 and the ground wireless communication device 10. The data received by the ground wireless communication device 10 is transmitted to the control device 40 and analyzed by the control device 40.

If the received signal level is equal to or higher than the first value (the query in step S33 is answered "YES"), that is, if the distance between the ground wireless communication device 10 and the on-vehicle wireless communication device 110 is equal to or shorter than the predetermined value, the control unit 11 stops the data transmission and places the ground wireless communication device 10 in the radar mode (second mode) (step S34).

That is to say, when the ground wireless communication device 10 detects in the first mode that the reception strength is equal to or greater than the first value, the ground wireless communication device 10 stops the data transmission to the on-vehicle wireless communication device 110, exits the first mode, and transitions to the second mode for determining whether the vehicle 100 is stopped.

In the radar mode, the control unit 11 operates the distance data extraction unit 18 and performs an FFT process to calculate the distance between the ground wireless communication device 10 and the on-vehicle wireless communication device 110 (step S35). The control unit 11 periodically repeats the distance measurement process at intervals of several microseconds to several seconds, and determines whether the currently measured distance is equal to the last measured distance (step S36).

If the currently measured distance is not equal to the last measured distance (the query in step S36 is answered "NO"), the control unit 11 determines whether the current distance measurement is made (step S42). If the current distance measurement is made (the query in step S42 is answered "YES"), the control unit 11 returns to step S35 and performs the distance measurement process. If, by contrast, the current distance measurement is not made (the query in step S42 is answered "NO"), the control unit 11 determines that the vehicle 100 has passed through without coming to a stop, proceeds to later-described step S41, and resets, or more specifically, erases the device number, train number, and other relevant information about the on-vehicle wireless communication device 110, which has been a communication partner. Subsequently, the control unit 11 proceeds to step S32 of the first mode.

Meanwhile, if the currently measured distance is equal to the last measured distance (the query in step S36 is answered "YES"), the control unit 11 determines that the vehicle 100 is stopped, and transitions from the radar mode to the data transmission mode (third mode).

If, in this instance, the last received signal level detected during the received signal level check in step S33 is equal to or higher than the first value and the vehicle 100 is stopped (the query in step S36 is answered "YES") (step S37), the control unit 11 transitions to the data transmission mode (third mode) and resumes the data transmission (step S38). In this manner, increased safety can be provided by enhancing the accuracy with which a stopped vehicle 100 is detected.

As described above, if the last reception strength detected in the first mode is equal to or greater than the first value after the detection of a stopped vehicle 100 in the second mode, the ground wireless communication device 10 exits the second mode and transitions to the third mode for transmitting data to the on-vehicle wireless communication device 110.

While the vehicle 100 is stopped in the data transmission mode (third mode), a bidirectional wireless transmission circuit is established. Consequently, the ground wireless communication device 10 is able to transmit image data to the on-vehicle wireless communication device 110 (step S39), and the on-vehicle wireless communication device 110 is able to transmit information data to the ground wireless communication device 10 (step S39).

For example, the ground wireless communication device 10 is able to transmit information indicative of a stopped vehicle 100, information indicative of whether the stop position of the vehicle 100 is within a predetermined range, and information indicative of the stop position of the vehicle 100 to the on-vehicle wireless communication device 110 and to the control device 40.

Further, when, for example, the operation/display device 120 receives a vehicle door opening instruction that is issued by the train driver 120*a* to open the door of the vehicle 100, request information (first door opening instruction information) for requesting a door opening operation of the movable fence device 30 is transmitted from the operation/display device 120 to the on-vehicle wireless communication device 110 and then wirelessly transmitted from the on-vehicle wireless communication device 110 to the ground wireless communication device 10. The first door opening instruction information is transmitted from the ground wireless communication device 10 to the control device 40 as second door opening instruction information for giving an instruction for a door opening operation. Upon deciphering the second door opening instruction information, the control device 40 transmits a door opening instruction control signal to the movable fence device 30. Upon receipt of the door opening instruction control signal, the movable fence device 30 operates to open its door.

If, in this instance, the stop position of the vehicle 100 is within the predetermined range, the ground wireless communication device 10 preferably transmits the second door opening instruction information to the control device 40. This prevents the door of the movable fence device 30 from opening when the vehicle is not in a normal stop position.

Furthermore, video information captured by the surveillance camera 20 to indicate, for example, the condition of the station platform 50 is wirelessly transmitted from the ground wireless communication device 10 to the on-vehicle wireless communication device 110 through the control device 40. The video information is then transmitted from the on-vehicle wireless communication device 110 to the operation/display device 120 and displayed on the operation/display device 120. Additionally, vehicle information about the vehicle 100 is transmitted from the on-vehicle wireless communication device 110 to the ground wireless communication device 10.

Moreover, when, for example, the operation/display device 120 receives a vehicle door closing instruction that is issued by the train driver 120*a* to close the door of the vehicle 100, first door closing instruction information for requesting a door closing operation of the movable fence device 30 is transmitted from the operation/display device 120 to the on-vehicle wireless communication device 110 and then wirelessly transmitted from the on-vehicle wireless communication device 110 to the ground wireless communication device 10. The first door closing instruction information is transmitted from the ground wireless communication device 10 to the control device 40 as second door closing instruction information for giving an instruction for a door closing operation. Upon deciphering the second door closing instruction information, the control device 40 transmits a door closing instruction control signal to the movable fence device 30. Upon receipt of the door closing instruction control signal, the movable fence device 30 operates to close its door.

Even while the vehicle 100 is stopped in the data transmission mode (third mode), the control unit 11 operates the received data extraction unit 16 to perform the data conversion process in the same manner as during a period while the vehicle 100 is moving in the data transmission mode (first mode). In the third mode, however, when the ground wireless communication device 10 receives data during a data transmission to the on-vehicle wireless communication device 110 (step S39), the control unit 11 determines whether the received signal level is equal to or lower than the second value (whether the received signal level is zero in the example of FIG. 10) (step S40).

When the vehicle 100 departs from the station platform 50 and reaches a position where communication cannot be established between the ground wireless communication device 10 and the on-vehicle wireless communication device 110, no data can be transmitted so that the received signal level is equal to or lower than the second value (e.g., zero). If the received signal level is neither equal to nor lower than the second value (the query in step S40 is answered "NO"), the control unit 11 returns to step S39, receives data, and determines whether the received signal level is equal to or lower than the second value (step S40).

If the received signal level is equal to or lower than the second value (the query in step S40 is answered "YES"), the control unit 11 resets (step S41), or more specifically, erases the device number, train number, and other relevant information about the on-vehicle wireless communication device 110, which has been a communication partner, transitions to the first mode, and enters the standby state to wait for the polling call signal. Upon receipt of a signal from the on-vehicle wireless communication device 110 (step S32), the control unit 11 checks whether the received signal level is equal to or higher than the first value (step S33).

As described above, after exiting the second mode, the ground wireless communication device 10 transitions to the third mode in order to transmit data to the on-vehicle wireless communication device 110 and determines whether the reception strength of a receiving signal is equal to or smaller than the second value. Upon detecting in the third mode that the reception strength is equal to or smaller than the second value, the ground wireless communication device 10 exits the third mode and transitions to the first mode.

Further, when the level of a signal received from the ground wireless communication device 10 is equal to or lower than a predetermined value (e.g., zero) after the departure of the vehicle 100 from the station platform 50, the on-vehicle wireless communication device 110 transitions to the first mode and turns off a monitor of the operation/display device 120. A noise screen displayed on the monitor to show the condition of the station platform 50 is then cleared. Additionally, the on-vehicle wireless communication device 110 resets, for example, the device number of the ground wireless communication device 10, which has been a communication partner, the station number, and the platform number, and then starts a new polling call.

As described above, the present embodiment transitions from the radar mode to the data transmission mode (third mode) only when the vehicle 100 is stopped. Therefore, even if the train driver 120*a* erroneously issues an instruction for opening the door of the vehicle 100 (i.e., a door opening instruction for the movable fence device 30) while the vehicle 100 is slowly moving in the radar mode (second mode), that is, the vehicle 100 is moving, the ground wireless communication device 10 is in the radar mode and does not receive the door opening instruction for the movable fence device 30. This prevents a door opening operation from being started by an erroneous operation of the train driver 120*a*. As a result, increased safety is provided.

In the example of FIG. 10, the control unit 11 of the ground wireless communication device 10 exercises control to make a mode transition from the radar mode (second mode) to the data transmission mode (third mode). However, such a mode transition may alternatively be made by the train driver 120*a*. When such an alternative scheme is employed, the train driver 120*a* uses the operation/display device 120 to issue an instruction for transitioning to the data transmission mode (third mode) after verifying that the vehicle 100 is stopped. In compliance with such an instruction, the control unit 11 transitions to the data transmission mode (third mode).

The present embodiment provides at least the following advantageous effects.

(1) The ground wireless communication device includes the wireless transmission/reception unit, which transmits data to the on-vehicle wireless communication device disposed on a vehicle and performs wireless transmission and reception in order to detect the stoppage of the vehicle. When, in the first mode for transmitting data to the on-vehicle wireless communication device and determining whether the reception strength of a received signal is equal to or greater than the first value, the ground wireless communication device detects that the reception strength is equal to or greater than the first value, the ground wireless communication device stops the transmission of data, exits the first mode, and transitions to the second mode for determining whether the vehicle is stopped. When the stoppage of the vehicle is detected in the second mode, the ground wireless communication device exits the second mode and transmits data to the on-vehicle wireless communication device. Consequently, the ground wireless communication device is able to perform a data transmission operation and a vehicle stoppage detection operation. This reduces the cost of ground facility installation.

(2) Further, after exiting the second mode, the ground wireless communication device transitions to the third mode for transmitting data to the on-vehicle wireless communication device and determining whether the reception strength of a received signal is equal to or smaller than the second value. Upon detecting in the third mode that the reception strength is equal to or smaller than the second value, the ground wireless communication device exits the third mode and transitions to the first mode. Consequently, when the vehicle transitions from a stopped state to a moving state, it is easy to transition to the first mode.

(3) When the stoppage of the vehicle is detected in the second mode and the reception strength is equal to or greater than the first value, the ground wireless communication device exits the second mode. Thus, an erroneous transition to the data transmission mode (third mode) can be prevented. Consequently, while the vehicle is moving after an erroneous transition to the third mode, a door opening operation of the movable fence device can be prevented.

(4) If the stoppage of the vehicle is not detected in the second mode, the present embodiment exits the second mode and transitions to the first mode. Consequently, a situation where the vehicle passes through a station without stopping can be properly handled.

(5) After exiting the second mode, the ground wireless communication device transmits a door opening signal to the control device in order to permit the movable fence device to open its door. Consequently, the door opening operation of the movable fence device can be prevented while the vehicle is moving.

(6) In the second mode, the ground wireless communication device detects the stoppage of the vehicle and determines whether the stop position of the vehicle is within a predetermined range. If the stop position is within the predetermined range, the ground wireless communication device exits the second mode. Consequently, the door opening operation of the movable fence device can be prevented while the vehicle is not in a normal stop position.

(7) The ground wireless communication device includes the oscillation unit, the transmission unit, the modulation signal supply unit, the reception unit, the received data extraction unit, and the distance data extraction unit. Further, the data transmission mode and the distance measurement mode (radar mode) share the oscillation unit, the transmission unit, and the reception unit. This makes it easy to implement both a data transmission function and a distance measurement function.

(8) A movable fence control system includes the on-vehicle wireless communication device, the ground wireless communication device, the movable fence device, and the control device. The ground wireless communication device selectively operates in the data transmission mode for wirelessly communicating with the on-vehicle wireless communication device and in the radar mode for wirelessly detecting the stoppage of a train. The movable fence device is disposed on a station platform and adapted to open and close the door of the movable fence device. Upon receipt of door opening instruction information for giving an instruction for a door opening operation from the ground wireless communication device, the control device exercises control to open the door. Consequently, the door of the movable fence device can be properly controlled based on the detection of train stoppage while reducing the cost of ground facility installation.

(9) The movable fence control system is configured so that, when the ground wireless communication device detects the stoppage of a train in the radar mode and then receives a signal requesting a door opening operation from the on-vehicle wireless communication device in the data transmission mode, the ground wireless communication device transmits the door opening instruction information to the control device. Consequently, the door opening operation of the movable fence device can be properly performed only when the stoppage of the train is detected.

(10) The ground wireless communication device selectively operates in the data transmission mode for wirelessly communicating with the on-vehicle wireless communication device and in the radar mode for wirelessly detecting the stoppage of the train. Further, when a signal requesting the door opening operation is received from the on-vehicle wireless communication device in the data transmission mode after detection of train stoppage in the radar mode, the ground wireless communication device transmits door opening instruction information for giving an instruction for a door opening operation to the control device for the movable fence device. Consequently, the door of the movable fence device can be properly controlled based on the detection of train stoppage while reducing the cost of ground facility installation.

(11) The movable fence device includes the control device that communicates with the ground wireless communication device, which selectively operates in the data transmission mode for wirelessly communicating with the on-vehicle wireless communication device disposed on a train and in the radar mode for wirelessly detecting the stoppage of the train. Further, upon receipt of door opening instruction information for giving an instruction for a door opening operation, the control device exercises control to open the door of the movable fence device. Consequently, the door of the movable fence device can be properly controlled based on the detection of train stoppage while reducing the cost of ground facility installation.

The present invention is not limited to the foregoing embodiment. Various changes and modifications can be made without departing from the spirit of the present invention.

In the foregoing embodiment, the ground wireless communication device checks the reception strength, transitions to the radar mode, and measures the distance to the on-vehicle wireless communication device in order to detect the stoppage of the vehicle. Upon detection of the stoppage of the vehicle, the ground wireless communication device starts a data transmission and checks the reception strength to detect whether the vehicle is moving. Alternatively, however, these operations may be performed by the on-vehicle wireless communication device.

In the foregoing embodiment, the on-vehicle wireless communication device transmits the polling call signal to let the ground wireless communication device respond. Alternatively, however, a reverse configuration may be employed. More specifically, the ground wireless communication device may transmit the polling call signal to let the on-vehicle wireless communication device respond.

The foregoing embodiment is configured so that the on-vehicle wireless communication device repeatedly transmits the polling call signal in the first mode even when the on-vehicle wireless communication device and the ground wireless communication device are at a great distance from each other. Alternatively, however, the first mode may be initiated when the on-vehicle wireless communication device and the ground wireless communication device are at a short distance from each other.

For example, an alternative is to use the radar mode when the on-vehicle wireless communication device and the ground wireless communication device are at a great distance from each other, transmit a call signal to the on-vehicle wireless communication device when the ground wireless communication device detects a train in the radar mode, and accordingly permit the on-vehicle wireless communication device and the ground wireless communication device to start a communication (particularly, a reception strength measurement by the ground wireless communication device). In this instance, the ground wireless communication device reverts to the radar mode after exiting the third mode (after the passage of the train).

Another alternative is to initiate the first mode based on an operation performed by a train driver. For example, the on-vehicle wireless communication device may transmit the call signal based on an operation of the on-vehicle wireless communication device or the operation/display device and accordingly permit the ground wireless communication device and the on-vehicle wireless communication device to start a communication (particularly, the reception strength measurement by the ground wireless communication device).

Still another alternative is to initiate the first mode when, for example, a position sensor detects that the train has approached a station platform, let the on-vehicle wireless communication device transmit the call signal, and accordingly permit the ground wireless communication device and the on-vehicle wireless communication device to start a communication (particularly, the reception strength measurement by the ground wireless communication device).

The foregoing embodiment has been described on the assumption that the ground wireless communication device transmits the door opening instruction information received from the on-vehicle wireless communication device to the control device when the stoppage of the vehicle is detected and the stop position of the vehicle is within the predetermined range. However, the present invention is not limited to such a configuration. For example, an alternative configuration may be employed so as to inhibit the door opening operation of the vehicle unless the on-vehicle wireless communication device receives a permission signal from the ground wireless communication device. The permission signal is, for example, the "STOPPAGE COMPLETE" signal (S14 in FIG. 3). Before the reception of the permission signal, the on-vehicle wireless communication device outputs a control signal for instructing the train driver to reject a vehicle door opening instruction to, for example, the operation/display device. As a result, the door of the vehicle does not open until the on-vehicle wireless communication device receives the permission signal. As far as the ground wireless communication device does not transmit the permission signal to the on-vehicle wireless communication device until the train is stopped within the predetermined range, neither the door of the vehicle nor the door of the movable fence device opens when the train erroneously stops at a position significantly apart from the stop position (stops at a position outside the predetermined range). This provides increased safety.

The foregoing embodiment is configured so that the movable fence device is separate from the control device. Alternatively, however, these devices may be integrated into a single device. For example, the control device may be incorporated into the movable fence device so that the control device is a part of the movable fence device.

The foregoing embodiment has been described on the assumption that the mobile object is a train. However, it is obvious that the present invention is applicable to mobile objects other than a train. The present invention can be applied, for example, to a bus, automobile, a ship, an airplane, and other mobile object that stops in a predetermined area. In such an instance, the ground wireless communication device detects that the mobile object is stopped in the predetermined area.

INDUSTRIAL APPLICABILITY

The present invention can be applied, for example, to a train stoppage determination technology and to a position determination technology.

REFERENCE SIGNS LIST

10 . . . Ground wireless communication device,
10*a* . . . Antenna,
11 . . . Control unit,
11*a* . . . FFT processing unit,
11*b* . . . Data conversion unit,
12 . . . Oscillation unit,
13 . . . Transmission unit,
13*a* . . . Distributor,
13*b* . . . Modulator,
13*c* . . . Transmission amplifier,
13*d* . . . Transmission antenna,
14 . . . Modulation signal supply unit (modulation driver),
15 . . . Reception unit,
15*a* . . . Reception antenna,
15*b* . . . Reception amplifier,
15*c* . . . Downconverter,
16 . . . Received data extraction unit,
16*a* . . . IF filter,
16*b* . . . IF amplifier,
16*c* . . . Envelope detector,
16*d* . . . Waveform shaper,
17 . . . Distributor,
18 . . . Distance data extraction unit,
18*a* . . . Low IF filter,
18*b* . . . Low IF amplifier,
18*c* . . . Low IF filter,
18*d* . . . A/D converter,
20 . . . Surveillance camera,
30 . . . Movable fence device,
40 . . . Control device,
50 . . . Station platform,
50*a* . . . Stop sign,
100 . . . Vehicle,
110 . . . On-vehicle wireless communication device,
110*a* . . . Antenna,
120 . . . Operation/display device,
120*a* . . . Train driver.

The invention claimed is:

1. A wireless communication system comprising:

a first wireless communication device; and a second wireless communication device that wirelessly communicates with the first wireless communication device, one of the first and second wireless communication devices being disposed in a mobile object, the other being fixed;

wherein the first wireless communication device includes a wireless transmission/reception unit that transmits data to the second wireless communication device and performs wireless transmission and reception in order to detect whether the mobile object is stopped;

wherein, when, in a first mode for transmitting data to the second wireless communication device and determining whether the reception strength of a received signal is equal to or greater than a first value, the first wireless communication device detects that the reception strength is equal to or greater than the first value, the first wireless communication device stops the transmission of data to the second wireless communication device, exits the first mode, and transitions to a second mode for determining whether the mobile object is stopped; and wherein, upon detecting in the second mode that the mobile object is stopped, the first wireless communication device exits the second mode and transmits data to the second wireless communication device.

2. The wireless communication system according to claim 1, wherein, upon exiting the second mode, the first wireless communication device transitions to a third mode for transmitting data to the second wireless communication device and determining whether the reception strength of a received signal is equal to or smaller than a second value; and wherein, upon detecting in the third mode that the reception strength is equal to or smaller than the second value, the first wireless communication device exits the third mode and transitions to the first mode.

3. The wireless communication system according to claim 1, wherein, when the stoppage of the mobile object is detected in the second mode and the last reception strength detected in the first mode is equal to or greater than a first value, the first wireless communication device exits the second mode.

4. The wireless communication system according to claim 1, wherein, when the stoppage of the mobile object is not detected in the second mode, the wireless communication system exits the second mode and transitions to the first mode.

5. The wireless communication system according to claim 1, further comprising:

a movable fence device that is disposed on a station platform to open and close a door of the movable fence device; and a control device that communicates with the first wireless communication device and controls the opening and closing of the door of the movable fence device;

wherein, upon exiting the second mode, the first wireless communication device transmits door opening instruction information to the control device, the door opening instruction information giving an instruction for opening the door of the movable fence device.

6. The wireless communication system according to claim 5, wherein, in the second mode, the first wireless communication device detects the stoppage of the mobile object and determines whether the stop position of the mobile object is within a predetermined range; and wherein, if the stop position is within the predetermined range, the first wireless communication device exits the second mode and transmits the door opening instruction information to the control device.

7. The wireless communication system according to claim 6, wherein the first wireless communication device detects the stoppage of the mobile object and the stop position of the mobile object in the second mode, exits the second mode, and transmits information about the stop position to the control device or to the second wireless communication device.

8. The wireless communication system according to claim 2, wherein the first wireless communication device further includes an oscillation unit, a transmission unit, a modulation signal supply unit, a reception unit, a received data extraction unit, and a distance data extraction unit;

wherein the wireless transmission/reception unit is configured to include the transmission unit and the reception unit;

wherein the oscillation unit, in the first mode and in the third mode, generates a carrier wave signal having a constant frequency and outputs the carrier wave signal to the transmission unit, and in the second mode, generates a distance measurement signal having a frequency varying at fixed intervals and outputs the distance measurement signal to the transmission unit;

wherein the modulation signal supply unit, in the first mode and in the third mode, generates a modulation signal based on transmission data and supplies the modulation signal to the transmission unit, and in the second mode, stops the generation of the modulation signal based on the transmission data;

wherein, in the first mode and in the third mode, the received data extraction unit extracts received data based on a signal transmitted from the reception unit; and wherein, in the second mode, the distance data extraction unit extracts data on the distance between the mobile object and the fixed wireless communication device based on the signal transmitted from the reception unit.

9. A wireless communication device that moves relative to a different wireless communication device and wirelessly communicates with the different wireless communication device, wherein the wireless communication device includes a wireless transmission/reception unit that transmits data to the different wireless communication device and performs wireless transmission and reception in order to detect whether the relative movement is stopped;

wherein, when, in a first mode for transmitting data to the different wireless communication device and determining whether the reception strength of a received signal is equal to or greater than a first value, the wireless communication device detects that the reception strength is equal to or greater than the first value, the wireless communication device stops the transmission of data to the different wireless communication device, exits the first mode, and transitions to a second mode for determining whether the relative movement is stopped; and wherein, upon detecting in the second mode that the relative movement is stopped, the wireless communication device exits the second mode and transmits data to the different wireless communication device.

10. The wireless communication device according to claim 9, wherein, upon exiting the second mode, the wireless communication device transitions to a third mode for transmitting data to the different wireless communication device and determining whether the reception strength of a received signal is equal to or smaller than a second value; and wherein, upon detecting in the third mode that the reception strength is equal to or smaller than the second value, the wireless communication device exits the third mode and transitions to the first mode.

11. The wireless communication device according to claim 10, further comprising:

an oscillation unit;

a transmission unit;

a modulation signal supply unit;

a reception unit;

a received data extraction unit; and a distance data extraction unit;

wherein the wireless transmission/reception unit is configured to include the transmission unit and the reception unit;

wherein the oscillation unit, in the first mode and in the third mode, generates a carrier wave signal having a constant frequency and outputs the carrier wave signal to the transmission unit, and in the second mode, generates a distance measurement signal having a frequency varying at fixed intervals and outputs the distance measurement signal to the transmission unit;

wherein the modulation signal supply unit, in the first mode and in the third mode, generates a modulation signal based on transmission data and supplies the modulation signal to the transmission unit, and in the second mode, stops the generation of the modulation signal based on the transmission data;

wherein, in the first mode and in the third mode, the received data extraction unit extracts received data based on a signal transmitted from the reception unit; and wherein, in the second mode, the distance data extraction unit extracts data on the distance between the mobile object and the wireless communication device or the different wireless communication device based on the signal transmitted from the reception unit.

12. A wireless communication method that is exercised between an on-vehicle wireless communication device and a ground wireless communication device, the on-vehicle wireless communication device being disposed in a mobile object, the wireless communication method comprising:

a first step of determining whether the reception strength of a received signal is equal to or greater than a first value while data is being wirelessly transmitted between the on-vehicle wireless communication device and the ground wireless communication device;

a second step of stopping the data transmission between the on-vehicle wireless communication device and the ground wireless communication device after detecting that the reception strength is equal to or greater than the first value, and wirelessly determining whether the mobile object is stopped; and a third step of wirelessly transmitting data between the on-vehicle wireless communication device and the ground wireless communication device after detecting that the mobile object is stopped.

13. The wireless communication method according to claim 12, wherein the third step includes determining the reception strength is equal to or smaller than a second value while data is being transmitted between the on-vehicle wireless communication device and the ground wireless communication device; and wherein, when the reception strength is determined to be equal to or smaller than the second value, a transition is made from the third step to the first step.

14. The wireless communication method according to claim 12, wherein the third step includes transmitting door opening instruction information from the ground wireless communication device to a movable fence device disposed on a station platform, the door opening instruction information giving an instruction for opening a door of the movable fence device.

15. The wireless communication method according to claim 14,

Wherein the second step includes detecting the stoppage of the mobile object and determining whether the stop position of the mobile object is within a predetermined range; and Wherein, if the stop position is within the predetermined range, the third step includes transmitting the door opening instruction information from the ground wireless communication to the movable fence device.

* * * * *